US008967980B2

(12) United States Patent
Fitton et al.

(10) Patent No.: US 8,967,980 B2
(45) Date of Patent: Mar. 3, 2015

(54) FAN ASSEMBLY

(75) Inventors: Nicholas Gerald Fitton, Malmesbury (GB); James John Thorn, Malmesbury (GB); Timothy Nicholas Stickney, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 648 days.

(21) Appl. No.: 13/275,034

(22) Filed: Oct. 17, 2011

(65) Prior Publication Data

US 2012/0093630 A1 Apr. 19, 2012

(30) Foreign Application Priority Data

Oct. 18, 2010 (GB) ..... 1017551.1
Apr. 4, 2011 (GB) ..... 1105687.6

(51) Int. Cl.

| | |
|---|---|
| ***F04F 5/20*** | (2006.01) |
| ***F04F 5/52*** | (2006.01) |
| ***F04D 25/08*** | (2006.01) |
| ***F04D 27/00*** | (2006.01) |
| ***F04F 5/16*** | (2006.01) |
| ***F04F 5/46*** | (2006.01) |

(52) U.S. Cl.

CPC ..... *F04D 25/08* (2013.01); *F04D 27/00* (2013.01); *F04F 5/16* (2013.01); *F04F 5/46* (2013.01); *F04F 5/461* (2013.01)

USPC ..... 417/178

(58) Field of Classification Search

CPC ..... F04D 25/08; F04D 27/00; F04F 5/461; F04F 5/464; F04F 5/14; F04F 5/16

USPC ..... 239/265.17, 434.5, 561, 568, DIG. 7, 239/565; 417/76, 79, 84, 155, 177, 179, 417/182, 188, 198, 349, 423.14, 424.1, 157, 417/277, 178; 415/51, 119, 126, 127; 416/9, 13, 16, 117, 118, 119

See application file for complete search history.

(56) References Cited

U.S. PATENT DOCUMENTS

| | | | |
|---|---|---|---|
| 284,962 | A | 9/1883 | Huston |
| 1,357,261 | A | 11/1920 | Svoboda |
| 1,767,060 | A | 6/1930 | Ferguson |

(Continued)

FOREIGN PATENT DOCUMENTS

| | | |
|---|---|---|
| BE | 560119 | 8/1957 |
| CA | 1055344 | 5/1979 |

(Continued)

OTHER PUBLICATIONS

Helps, D. F. et al., U.S. Office Action mailed Feb. 15, 2013, directed to U.S. Appl. No. 12/716,694; 12 pages.

(Continued)

*Primary Examiner* — Bryan Lettman
(74) *Attorney, Agent, or Firm* — Morrison & Foerster LLP

(57) ABSTRACT

A fan assembly includes a nozzle and a system for creating a primary air flow through the nozzle. The nozzle includes an outlet for emitting the primary air flow, and defines an opening through which a secondary air flow from outside the fan assembly is drawn by the primary air flow emitted from the outlet. To allow a parameter of an air flow, formed from the combination of the primary and secondary air flows, to be adjusted by a user, the nozzle has an adjustable configuration.

31 Claims, 17 Drawing Sheets

(56) References Cited

U.S. PATENT DOCUMENTS 1,896,869 A 2/1933 Larsh
2,014,185 A 9/1935 Martin
2,035,733 A 3/1936 Wall
2,071,266 A 2/1937 Schmidt
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,295,502 A 9/1942 Lamb
2,336,295 A 12/1943 Reimuller
2,363,839 A 11/1944 Demuth
2,433,795 A 12/1947 Stokes
2,473,325 A 6/1949 Aufiero
2,476,002 A 7/1949 Stalker
2,488,467 A * 11/1949 De Lisio Salvatore ..... 239/561
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,711,682 A 6/1955 Drechsel
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,503,138 A 3/1970 Fuchs et al.
3,518,776 A 7/1970 Wolff et al.
3,724,092 A 4/1973 McCleerey
3,729,934 A 5/1973 Denning et al.
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,090,814 A 5/1978 Teodorescu et al.
4,113,416 A 9/1978 Kataoka et al.
4,136,735 A 1/1979 Beck et al.
4,173,995 A 11/1979 Beck
4,180,130 A 12/1979 Beck et al.
4,184,417 A 1/1980 Chancellor
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A * 1/1988 Watts ..... 440/47
4,732,539 A 3/1988 Shin-Chin
4,734,017 A 3/1988 Levin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger, IV
5,061,405 A 10/1991 Stanek et al.
D325,435 S 4/1992 Coup et al.
5,110,266 A 5/1992 Toyoshima et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,407,324 A 4/1995 Starnes, Jr. et al.
5,425,902 A 6/1995 Miller et al.
5,435,489 A 7/1995 Jenkins et al.
5,518,370 A 5/1996 Wang et al.
5,609,473 A 3/1997 Litvin
5,645,769 A 7/1997 Tamaru et al.
5,649,370 A 7/1997 Russo
5,671,321 A 9/1997 Bagnuolo
5,735,683 A 4/1998 Muschelknautz
5,762,034 A 6/1998 Foss
5,762,661 A 6/1998 Kleinberger et al.
5,783,117 A 7/1998 Byassee et al.
5,794,306 A 8/1998 Firdaus
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
6,604,694 B1 8/2003 Kordas et al.
D485,895 S 1/2004 Melwani
6,789,787 B2 9/2004 Stutts
6,791,056 B2 9/2004 VanOtteren et al.
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
7,192,258 B2 3/2007 Kuo et al.
7,198,473 B2 4/2007 Stickland et al.
7,412,781 B2 8/2008 Mattinger et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,660,110 B2 2/2010 Vinson et al.
7,664,377 B2 2/2010 Liao
D614,280 S 4/2010 Dyson et al.
7,731,050 B2 6/2010 Parks et al.
7,775,848 B1 8/2010 Auerbach
7,806,388 B2 10/2010 Junkel et al.
7,841,045 B2 11/2010 Shaanan et al.
8,002,520 B2 8/2011 Dawson et al.
8,092,166 B2 1/2012 Nicolas et al.
8,113,490 B2 2/2012 Chen
8,152,495 B2 4/2012 Boggess, Jr. et al.
8,246,317 B2 8/2012 Gammack
8,308,445 B2 11/2012 Gammack et al.
8,348,629 B2 1/2013 Fitton et al.
8,356,804 B2 1/2013 Fitton et al.
8,454,322 B2 6/2013 Gammack et al.
8,529,226 B2 9/2013 Li
8,544,826 B2 10/2013 Ediger et al.
8,721,307 B2 5/2014 Li
2002/0106547 A1 8/2002 Sugawara et al.

(56) References Cited

U.S. PATENT DOCUMENTS

| | | | |
|---|---|---|---|
| 2003/0059307 | A1 | 3/2003 | Moreno et al. |
| 2003/0164367 | A1 | 9/2003 | Bucher et al. |
| 2003/0171093 | A1 | 9/2003 | Gumucio Del Pozo |
| 2003/0190183 | A1 | 10/2003 | Hsing |
| 2004/0022631 | A1 | 2/2004 | Birdsell et al. |
| 2004/0049842 | A1 | 3/2004 | Prehodka |
| 2004/0106370 | A1 | 6/2004 | Honda et al. |
| 2004/0149881 | A1 | 8/2004 | Allen |
| 2005/0031448 | A1 | 2/2005 | Lasko et al. |
| 2005/0053465 | A1 | 3/2005 | Roach et al. |
| 2005/0069407 | A1 | 3/2005 | Winkler et al. |
| 2005/0128698 | A1 | 6/2005 | Huang |
| 2005/0163670 | A1 | 7/2005 | Alleyne et al. |
| 2005/0173997 | A1 | 8/2005 | Schmid et al. |
| 2005/0281672 | A1 | 12/2005 | Parker et al. |
| 2006/0172682 | A1 | 8/2006 | Orr et al. |
| 2006/0199515 | A1 | 9/2006 | Lasko et al. |
| 2006/0263073 | A1 | 11/2006 | Clarke et al. |
| 2006/0279927 | A1 | 12/2006 | Strohm |
| 2007/0035189 | A1 | 2/2007 | Matsumoto |
| 2007/0041857 | A1 | 2/2007 | Fleig |
| 2007/0065280 | A1 | 3/2007 | Fok |
| 2007/0166160 | A1 | 7/2007 | Russak et al. |
| 2007/0176502 | A1 | 8/2007 | Kasai et al. |
| 2007/0224044 | A1 | 9/2007 | Hong et al. |
| 2007/0269323 | A1 | 11/2007 | Zhou et al. |
| 2008/0020698 | A1 | 1/2008 | Spaggiari |
| 2008/0124060 | A1 | 5/2008 | Gao |
| 2008/0152482 | A1 | 6/2008 | Patel |
| 2008/0166224 | A1 | 7/2008 | Giffin |
| 2008/0286130 | A1 | 11/2008 | Purvines |
| 2008/0314250 | A1 | 12/2008 | Cowie et al. |
| 2009/0026850 | A1 | 1/2009 | Fu |
| 2009/0032130 | A1 | 2/2009 | Dumas et al. |
| 2009/0039805 | A1 | 2/2009 | Tang |
| 2009/0060710 | A1 | 3/2009 | Gammack et al. |
| 2009/0060711 | A1 | 3/2009 | Gammack et al. |
| 2009/0078120 | A1 | 3/2009 | Kummer et al. |
| 2009/0120925 | A1 | 5/2009 | Lasko |
| 2009/0191054 | A1 | 7/2009 | Winkler |
| 2009/0214341 | A1 | 8/2009 | Craig |
| 2010/0133707 | A1 | 6/2010 | Huang |
| 2010/0150699 | A1 | 6/2010 | Nicolas et al. |
| 2010/0162011 | A1 | 6/2010 | Min |
| 2010/0171465 | A1 | 7/2010 | Seal et al. |
| 2010/0225012 | A1 | 9/2010 | Fitton et al. |
| 2010/0226749 | A1 | 9/2010 | Gammack et al. |
| 2010/0226750 | A1 | 9/2010 | Gammack |
| 2010/0226751 | A1 | 9/2010 | Gammack et al. |
| 2010/0226752 | A1 | 9/2010 | Gammack et al. |
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226763 | A1 | 9/2010 | Gammack et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0058935 | A1 | 3/2011 | Gammack et al. |
| 2011/0110805 | A1 | 5/2011 | Gammack et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0114513 | A1 | 5/2012 | Simmonds et al. |
| 2012/0230658 | A1 | 9/2012 | Fitton et al. |
| 2012/0308375 | A1 | 12/2012 | Gammack |
| 2013/0026664 | A1 | 1/2013 | Staniforth et al. |
| 2013/0028763 | A1 | 1/2013 | Staniforth et al. |
| 2013/0028766 | A1 | 1/2013 | Staniforth et al. |
| 2013/0129490 | A1 | 5/2013 | Dos Reis et al. |
| 2013/0161842 | A1 | 6/2013 | Fitton et al. |
| 2013/0199372 | A1 | 8/2013 | Nock et al. |
| 2013/0272858 | A1 | 10/2013 | Stickney et al. |
| 2013/0280051 | A1 | 10/2013 | Nicolas et al. |
| 2013/0280061 | A1 | 10/2013 | Stickney |
| 2013/0280096 | A1 | 10/2013 | Gammack et al. |
| 2013/0323100 | A1 | 12/2013 | Poulton et al. |
| 2014/0079566 | A1 | 3/2014 | Gammack et al. |
| 2014/0084492 | A1 | 3/2014 | Staniforth et al. |
| 2014/0210114 | A1 | 7/2014 | Staniforth et al. |
| 2014/0255173 | A1 | 9/2014 | Poulton et al. |
| 2014/0255217 | A1 | 9/2014 | Li |

FOREIGN PATENT DOCUMENTS

| | | |
|---|---|---|
| CA | 2155482 | 9/1996 |
| CN | 2085866 | 10/1991 |
| CN | 2111392 | 7/1992 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 201011346 | 1/2008 |
| CN | 201180678 | 1/2009 |
| CN | 201221477 | 4/2009 |
| CN | 101424279 | 5/2009 |
| CN | 101451754 | 6/2009 |
| CN | 201281416 | 7/2009 |
| CN | 201349269 | 11/2009 |
| CN | 101684828 | 3/2010 |
| CN | 201486901 | 5/2010 |
| CN | 101749288 | 6/2010 |
| CN | 201502549 | 6/2010 |
| CN | 201507461 | 6/2010 |
| CN | 101825096 | 9/2010 |
| CN | 101825101 | 9/2010 |
| CN | 101825102 | 9/2010 |
| CN | 101825103 A | 9/2010 |
| CN | 101825104 | 9/2010 |
| CN | 201568337 | 9/2010 |
| CN | 101858355 | 10/2010 |
| CN | 101936310 | 1/2011 |
| CN | 201696365 U | 1/2011 |
| CN | 201696366 | 1/2011 |
| CN | 201739199 U | 2/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201771875 | 3/2011 |
| CN | 201779080 | 3/2011 |
| CN | 201786777 | 4/2011 |
| CN | 201786778 | 4/2011 |
| CN | 201802648 | 4/2011 |
| CN | 102095236 | 6/2011 |
| CN | 201858204 | 6/2011 |
| CN | 201874898 | 6/2011 |
| CN | 201874901 U | 6/2011 |
| CN | 201917047 | 8/2011 |
| CN | 102251973 A | 11/2011 |
| CN | 102287357 | 12/2011 |
| CN | 102367813 | 3/2012 |
| CN | 202267207 | 6/2012 |
| CN | 202431623 | 9/2012 |
| DE | 1 291 090 | 3/1969 |
| DE | 24 51 557 | 5/1976 |
| DE | 27 48 724 | 5/1978 |
| DE | 3644567 | 7/1988 |
| DE | 195 10 397 | 9/1996 |
| DE | 197 12 228 | 10/1998 |

(56) References Cited

FOREIGN PATENT DOCUMENTS

| | | | |
|---|---|---|---|
| DE | 100 00 400 | | 3/2001 |
| DE | 10041805 | | 6/2002 |
| DE | 10 2009 007 037 | | 8/2010 |
| EP | 0 044 494 | | 1/1982 |
| EP | 0186581 | | 7/1986 |
| EP | 0 784 947 | | 7/1997 |
| EP | 1 094 224 | | 4/2001 |
| EP | 1 138 954 | | 10/2001 |
| EP | 1357296 | B1 | 10/2003 |
| EP | 1 779 745 | | 5/2007 |
| EP | 1 939 456 | | 7/2008 |
| EP | 1 980 432 | | 10/2008 |
| EP | 2 000 675 | | 12/2008 |
| EP | 2191142 | | 6/2010 |
| EP | 2 578 889 | | 4/2013 |
| FR | 1033034 | | 7/1953 |
| FR | 1119439 | | 6/1956 |
| FR | 1387334 | | 1/1965 |
| FR | 2 375 471 | | 7/1978 |
| FR | 2 534 983 | | 4/1984 |
| FR | 2 640 857 | | 6/1990 |
| FR | 2 658 593 | | 8/1991 |
| FR | 2794195 | | 12/2000 |
| FR | 2 874 409 | | 2/2006 |
| FR | 2 906 980 | | 4/2008 |
| FR | 2928706 | | 9/2009 |
| GB | 22235 | | 6/1914 |
| GB | 383498 | | 11/1932 |
| GB | 593828 | | 10/1947 |
| GB | 601222 | | 4/1948 |
| GB | 633273 | | 12/1949 |
| GB | 641622 | | 8/1950 |
| GB | 661747 | | 11/1951 |
| GB | 863 124 | | 3/1961 |
| GB | 1067956 | | 5/1967 |
| GB | 1 262 131 | | 2/1972 |
| GB | 1 265 341 | | 3/1972 |
| GB | 1 278 606 | | 6/1972 |
| GB | 1 304 560 | | 1/1973 |
| GB | 1 403 188 | | 8/1975 |
| GB | 1 434 226 | | 5/1976 |
| GB | 1 501 473 | | 2/1978 |
| GB | 2 094 400 | | 9/1982 |
| GB | 2 107 787 | | 5/1983 |
| GB | 2 111 125 | | 6/1983 |
| GB | 2 178 256 | | 2/1987 |
| GB | 2 185 531 | | 7/1987 |
| GB | 2 185 533 | | 7/1987 |
| GB | 2 218 196 | | 11/1989 |
| GB | 2 236 804 | | 4/1991 |
| GB | 2 240 268 | | 7/1991 |
| GB | 2 242 935 | | 10/1991 |
| GB | 2 285 504 | | 7/1995 |
| GB | 2 289 087 | | 11/1995 |
| GB | 2493231 | A | 1/2003 |
| GB | 2383277 | | 6/2003 |
| GB | 2 428 569 | | 2/2007 |
| GB | 2 452 593 | | 3/2009 |
| GB | 2452490 | | 3/2009 |
| GB | 2463698 | | 3/2010 |
| GB | 2464736 | | 4/2010 |
| GB | 2466058 | | 6/2010 |
| GB | 2468312 | | 9/2010 |
| GB | 2468313 | | 9/2010 |
| GB | 2468315 | | 9/2010 |
| GB | 2468317 | A | 9/2010 |
| GB | 2468319 | | 9/2010 |
| GB | 2468320 | | 9/2010 |
| GB | 2468323 | | 9/2010 |
| GB | 2468328 | | 9/2010 |
| GB | 2468331 | | 9/2010 |
| GB | 2468369 | | 9/2010 |
| GB | 2468498 | | 9/2010 |
| GB | 2473037 | | 3/2011 |
| GB | 2479760 | | 10/2011 |
| GB | 2482547 | | 2/2012 |
| GB | 2484671 | | 4/2012 |
| GB | 2484695 | A | 4/2012 |
| GB | 2484761 | | 4/2012 |
| GB | 2493505 | A | 2/2013 |
| GB | 2493507 | A | 2/2013 |
| GB | 2500011 | | 9/2013 |
| JP | 31-13055 | | 8/1956 |
| JP | 35-4369 | | 3/1960 |
| JP | 39-7297 | | 3/1964 |
| JP | 46-7230 | | 12/1971 |
| JP | 49-150403 | | 12/1974 |
| JP | 51-7258 | | 1/1976 |
| JP | 53-60100 | | 5/1978 |
| JP | 56-167897 | | 12/1981 |
| JP | 57-71000 | | 5/1982 |
| JP | 57-157097 | | 9/1982 |
| JP | 61-31830 | | 2/1986 |
| JP | 61-116093 | | 6/1986 |
| JP | 61-280787 | | 12/1986 |
| JP | 62-223494 | | 10/1987 |
| JP | 63-36794 | | 3/1988 |
| JP | 63-179198 | | 7/1988 |
| JP | 63-306340 | | 12/1988 |
| JP | 64-21300 | U | 2/1989 |
| JP | 64-83884 | | 3/1989 |
| JP | 1-138399 | | 5/1989 |
| JP | 1-224598 | | 9/1989 |
| JP | 2-146294 | | 6/1990 |
| JP | 2-218890 | | 8/1990 |
| JP | 2-248690 | | 10/1990 |
| JP | 3-52515 | | 5/1991 |
| JP | 3-267598 | | 11/1991 |
| JP | 3-286775 | | 12/1991 |
| JP | 4-43895 | | 2/1992 |
| JP | 4-366330 | | 12/1992 |
| JP | 5-157093 | | 6/1993 |
| JP | 5-164089 | | 6/1993 |
| JP | 5-263786 | | 10/1993 |
| JP | 6-74190 | | 3/1994 |
| JP | 6-86898 | | 3/1994 |
| JP | 6-147188 | | 5/1994 |
| JP | 6-257591 | | 9/1994 |
| JP | 6-280800 | | 10/1994 |
| JP | 6-336113 | | 12/1994 |
| JP | 7-190443 | | 7/1995 |
| JP | 8-21400 | | 1/1996 |
| JP | 9-100800 | | 4/1997 |
| JP | 9-178083 | | 7/1997 |
| JP | 9-287600 | | 11/1997 |
| JP | 11-502586 | | 3/1999 |
| JP | 11-227866 | | 8/1999 |
| JP | 2000-116179 | | 4/2000 |
| JP | 2000-201723 | | 7/2000 |
| JP | 2001-17358 | | 1/2001 |
| JP | 2002-21797 | | 1/2002 |
| JP | 2002-138829 | | 5/2002 |
| JP | 2002-213388 | | 7/2002 |
| JP | 2003-329273 | | 11/2003 |
| JP | 2004-8275 | | 1/2004 |
| JP | 2004-208935 | | 7/2004 |
| JP | 2004-216221 | | 8/2004 |
| JP | 2005-201507 | | 7/2005 |
| JP | 2005-307985 | | 11/2005 |
| JP | 2006-89096 | | 4/2006 |
| JP | 3127331 | | 11/2006 |
| JP | 2007-138763 | | 6/2007 |
| JP | 2007-138789 | | 6/2007 |
| JP | 2008-39316 | | 2/2008 |
| JP | 2008-100204 | | 5/2008 |
| JP | 3146538 | | 10/2008 |
| JP | 2008-294243 | | 12/2008 |
| JP | 2009-44568 | | 2/2009 |
| JP | 2009-62986 | | 3/2009 |
| JP | 2010-131259 | | 6/2010 |
| JP | 2010-203764 | | 9/2010 |
| JP | 2012-31806 | | 2/2012 |
| KR | 1999-002660 | | 1/1999 |
| KR | 10-2005-0102317 | | 10/2005 |

(56) References Cited

FOREIGN PATENT DOCUMENTS

| | | | |
|---|---|---|---|
| KR | 2007-0007997 | | 1/2007 |
| KR | 20-0448319 | | 3/2010 |
| KR | 10-2010-0055611 | | 5/2010 |
| KR | 10-0985378 | | 9/2010 |
| TW | 517825 | | 1/2003 |
| TW | 589932 | | 6/2004 |
| TW | M394383 | | 12/2010 |
| TW | M399207 | | 3/2011 |
| TW | M407299 | | 7/2011 |
| WO | WO 90/13478 | | 11/1990 |
| WO | WO-95/06822 | | 3/1995 |
| WO | WO-02/073096 | | 9/2002 |
| WO | WO 03/058795 | | 7/2003 |
| WO | WO-03/069931 | | 8/2003 |
| WO | WO-2005/050026 | | 6/2005 |
| WO | WO 2005/057091 | | 6/2005 |
| WO | WO-2006/008021 | | 1/2006 |
| WO | WO-2006/012526 | | 2/2006 |
| WO | WO 2007/024955 | | 3/2007 |
| WO | WO 2007/048205 | | 5/2007 |
| WO | WO 2008/014641 | | 2/2008 |
| WO | WO-2008/024569 | | 2/2008 |
| WO | WO-2008/139491 | | 11/2008 |
| WO | WO-2009/030879 | | 3/2009 |
| WO | WO-2009/030881 | | 3/2009 |
| WO | WO-2010/100449 | A1 | 9/2010 |
| WO | WO-2010/100451 | | 9/2010 |
| WO | WO-2010/100452 | | 9/2010 |
| WO | WO-2010/100453 | | 9/2010 |
| WO | WO-2010/100462 | | 9/2010 |
| WO | WO-2011/050041 | | 4/2011 |
| WO | WO-2012/006882 | A1 | 1/2012 |
| WO | WO-2012/033517 | A1 | 3/2012 |
| WO | WO-2013/014419 | A2 | 1/2013 |

OTHER PUBLICATIONS

Fitton et al., U.S. Office Action mailed Mar. 30, 2012, directed to U.S. Appl. No. 12/716,707; 7 pages.
Gammack et al., Office Action mailed Jun. 12, 2013, directed towards U.S. Appl. No. 12/945,558; 20 pages.
Gammack et al., Office Action mailed May 29, 2013, directed towards U.S. Appl. No. 13/588,666; 11 pages.
Wallace et al., Office Action mailed Jun. 7, 2013, directed towards U.S. Appl. No. 13/192,223; 30 pages.
Gammack, P. et al., U.S. Office Action mailed Jun. 8, 2012, directed to U.S. Appl. No. 12/230,613; 15 pages.
Gammack, P. et al., U.S. Office Action mailed Jun. 25, 2012, directed to U.S. Appl. No. 12/716,749; 11 pages.
Gammack et al., Office Action mailed Sep. 17, 2012, directed to U.S. Appl. No. 13/114,707; 12 pages.
Gammack et al., U.S. Office Action mailed Aug. 20, 2012, directed to U.S. Appl. No. 12/945,558; 15 pages.
Gammack et al., U.S. Office Action mailed Sep. 6, 2013, directed to U.S. Appl. No. 12/716,740; 15 pages.
Gammack et al., Office Action mailed Sep. 27, 2013, directed to U.S. Appl. No. 13/588,666; 10 pages.
Wallace et al., Office Action mailed Oct. 23, 2013, directed to U.S. Appl. No. 13/192,223; 18 pages.
Fitton et al., U.S. Office Action mailed Dec. 31, 2013, directed to U.S. Appl. No. 13/718,693; 8 pages.
Gammack, P. et al. U.S. Office Action mailed Oct. 18, 2012, directed to U.S. Appl. No. 12/917,247; 11 pages.
GB Search Report dated Jan. 26, 2011, directed to GB Application No. 1017551.1; 1 page.
Gammack, P. et al., U.S. Office Action mailed Dec. 9, 2010, directed to U.S. Appl. No. 12/203,698; 10 pages.
Gammack, P. et al., U.S. Office Action mailed Jun. 21, 2011, directed to U.S. Appl. No. 12/203,698; 11 pages.
Gammack, P. et al., U.S. Office Action mailed Dec. 10, 2010, directed to U.S. Appl. No. 12/230,613; 12 pages.
Gammack, P. et al., U.S. Office Action mailed May 13, 2011, directed to U.S. Appl. No. 12/230,613; 13 pages.
Gammack, P. et al., U.S. Office Action mailed Sep. 7, 2011, directed to U.S. Appl. No. 12/230,613; 15 pages.
Fitton et al., U.S. Office Action mailed Nov. 30, 2010 directed to U.S. Appl. No. 12/560,232; 9 pages.
Nicolas, F. et al., U.S. Office Action mailed Mar. 7, 2011, directed to U.S. Appl. No. 12/622,844; 10 pages.
Nicolas, F. et al., U.S. Office Action mailed Sep. 8, 2011, directed to U.S. Appl. No. 12/622,844; 11 pages.
Fitton, et al., U.S. Office Action mailed Mar. 8, 2011, directed to U.S. Appl. No. 12/716,780; 12 pages.
Fitton, et al., U.S. Office Action mailed Sep. 6, 2011, directed to U.S. Appl. No. 12/716,780; 16 pages.
Gammack, P. et al., U.S. Office Action mailed Dec. 9, 2010, directed to U.S. Appl. No. 12/716,781; 17 pages.
Gammack, P. et al., U.S. Final Office Action mailed Jun. 24, 2011, directed to U.S. Appl. No. 12/716,781; 19 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed May 24, 2011, directed to U.S. Appl. No. 12/716,613; 9 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Gammack, P. et al., Office Action mailed Aug. 19, 2013, directed to U.S. Appl. No. 12/716,515; 20 pages.
Gammack et al., U.S. Office Action mailed Feb. 28, 2013, directed to U.S. Appl. No. 12/945,558; 16 pages.
Gammack et al., U.S. Office Action mailed Feb. 14, 2013, directed to U.S. Appl. No. 12/716,515; 21 pages.
Gammack et al., U.S. Office Action mailed Mar. 14, 2013, directed to U.S. Appl. No. 12/716,740; 15 pages.
Search Report dated Jan. 17, 2013, directed to GB Application No. 1216802.7; 2 pages.
Search Report dated Jan. 17, 2013, directed to GB Application No. 1216803.5; 2 pages.
Gammack, P. et al., U.S. Office Action mailed Feb. 10, 2014, directed to U.S. Appl. No. 12/716,515; 21 pages.
GB Search Report dated Jan. 12, 2012, directed to GB Patent Application No. 1105687.6; 2 pages.
International Search Report and Written Opinion mailed Jan. 20, 2012, directed to International Patent Application No. PCT/GB2011/051815; 8 pages.
Li et al., U.S. Office Action mailed Oct. 25, 2013, directed to U.S. Appl. No. 13/686,480; 17 pages.
Gammack et al., U.S. Office Action mailed Apr. 24, 2014, directed to U.S Appl. No. 12/716,740; 16 pages.
Gammack et al., U.S. Office Action mailed Sep. 3, 2014, directed to U.S. Appl. No. 13/861,891; 7 pages.
Staniforth et al., U.S. Office Action mailed Sep. 18, 2014, directed to U.S. Appl. No. 13/559,142; 18 pages.
Fitton et al., U.S. Office Action mailed Jun. 13, 2014, directed to U.S. Appl. No. 13/274,998; 11 pages.

* cited by examiner

FAN ASSEMBLY

REFERENCE TO RELATED APPLICATIONS

This application claims the priority of United Kingdom Application No. 1017551.1 filed Oct. 18, 2010, and United Kingdom Application No. 1105687.6, filed Apr. 4, 2011, the entire contents of which are incorporated herein by reference.

FIELD OF THE INVENTION

The present invention relates to a fan assembly. Particularly, but not exclusively, the present invention relates to a floor or table-top fan assembly, such as a desk, tower or pedestal fan.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows an air flow to pass through the housing while preventing users from coming into contact with the rotating blades during use of the fan.

WO 2009/030879 describes a fan assembly which does not use caged blades to project air from the fan assembly. Instead, the fan assembly comprises a cylindrical base which houses a motor-driven impeller for drawing a primary air flow into the base, and an annular nozzle connected to the base and comprising an annular mouth through which the primary air flow is emitted from the fan. The nozzle defines an opening through which air in the local environment of the fan assembly is drawn by the primary air flow emitted from the mouth, amplifying the primary air flow. The nozzle includes a Coanda surface over which the mouth is arranged to direct the primary air flow. The Coanda surface extends symmetrically about the central axis of the opening so that the air flow generated by the fan assembly is in the form of an annular jet having a cylindrical or frusto-conical profile.

SUMMARY OF THE INVENTION

In a first aspect the present invention provides a fan assembly comprising a nozzle and a system for creating a primary air flow through the nozzle. The nozzle comprises at least one outlet for emitting the primary air flow, and defines an opening through which a secondary air flow from outside the fan assembly is drawn by the primary air flow emitted from the at least one outlet. To allow at least one parameter of an air flow, formed from the combination of the primary and secondary air flows, to be adjusted by a user, the nozzle has an adjustable configuration.

The at least one parameter of the combined air flow may comprise at least one of the profile, orientation, direction, flow rate (as measured, for example, in liters per second), and velocity of the combined air flow. Thus, through adjusting the configuration of the nozzle a user may adjust the direction in which the combined air flow is projected forward from the fan assembly, for example to angle the air flow towards or away from a person in the vicinity of the fan assembly. Alternatively, or additionally, the user may expand or restrict the profile of the combined air flow to increase or decrease the number of users within the path of the air flow. As another alternative the user may change the orientation of the air flow, for example through the rotation of a relatively narrow air flow to provide a relatively wide air flow for cooling a number of users.

The nozzle may be adjustable to adopt one of a number of discrete configurations. The nozzle may be locked in a selected configuration so that the configuration of the nozzle cannot be adjusted later by a user. However, it is preferred that the nozzle may be releasable or otherwise moveable from a selected configuration to allow a user to adjust the configuration of the nozzle as required during the use of the fan assembly.

The configuration of the nozzle may be adjusted manually by the user, or it may be adjusted automatically by an automated mechanism of the fan assembly, for example in response to a user operation of a user interface of the fan assembly. This user interface may be located on a body of the fan assembly, or it may be provided by a remote control connected wirelessly to the fan assembly.

The configuration of the nozzle may be adjusted by altering the position, shape or state of at least one part of the nozzle. This part of the nozzle may be rotated, translated, pivoted, extended, retracted, expanded, contracted, slid or otherwise moved relative to another part of the nozzle to adjust the configuration of the nozzle.

For example, the size and shape of the opening may be fixed, and so a part of the nozzle may be moved relative to the opening to adjust the configuration of the nozzle. Alternatively, or additionally, the size and shape of the at least one outlet may be fixed, and so a part of the nozzle may be moved relative to the at least one outlet to adjust the configuration of the nozzle. This moveable part of the nozzle may be located upstream or downstream of the at least one outlet, but in a preferred embodiment the moveable part of the nozzle is located downstream of the at least one outlet.

The nozzle may comprise a first part, and a second part which is moveable relative to the first part, thereby adjusting the configuration of the nozzle. As mentioned above, this second part of the nozzle may be moveable relative to the opening, which may remain in a fixed configuration as the second part of the nozzle is moved relative thereto. Alternatively, or additionally, this second part of the nozzle may be moveable relative to the at least one outlet, which may remain in a fixed configuration as the second part of the nozzle is moved relative thereto.

The second part of the nozzle preferably comprises a flow guiding member. The flow guiding member may be selectively exposed to at least the primary air flow to vary said at least one parameter of the combined air flow. Alternatively, or additionally, at least one of the position and the orientation of the flow guiding member relative to the opening or the at least one air outlet may be adjusted to vary said at least one parameter of the combined air flow.

The second part of the nozzle is preferably rotatable relative to the first part of the nozzle. Alternatively, or additionally, the second part of the nozzle may be slidably moveable relative to the first part of the nozzle.

The second part of the nozzle may be mounted on an external surface of the nozzle. The second part of the nozzle may be moved over this external surface to vary the configuration of the nozzle.

The second part of the nozzle may be moveable relative to the first part of the nozzle between a stowed position and at least one deployed position, for example, to vary a parameter of the combined air flow generated by the fan assembly. In the stowed position the first part of the nozzle may be shielded from the air flow, whereas in each of the deployed positions the first part of the nozzle may be exposed to the combined air flow to adjust a parameter of the air flow generated by the fan assembly by a respective different amount. For example, in each of the deployed positions the second part of the nozzle may be exposed to the air flow by a respective different amount.

The second part of the nozzle may be moveable between a first position in which the combined air flow generated by the fan assembly has a first parameter, for example a first orientation, a first shape or a first direction, and a second position in which the combined air flow generated by the fan assembly has a second parameter, for example a second orientation, a second shape or a second direction, which is different from the first parameter. In each position, the second part of the nozzle may be exposed to the primary air flow.

The first part of the nozzle may be located downstream from the at least one outlet. The first part of the nozzle is preferably maintained in a fixed position relative to the at least one outlet as the second part of the nozzle is moved between the stowed position and the at least one deployed position. In the at least one deployed position, the second part of the nozzle is preferably located downstream from the first part of the nozzle.

The first part of the nozzle preferably comprises a surface over which the at least one outlet is arranged to direct the air flow. Preferably, the surface over which the at least one outlet is arranged to direct the air flow comprises a Coanda surface. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment in which a primary air flow is directed over a Coanda surface. A description of the features of a Coanda surface, and the effect of fluid flow over a Coanda surface, can be found in articles such as Reba, Scientific American, Volume 214, June 1966 pages 84 to 92. Through use of a Coanda surface, an increased amount of air from outside the fan assembly is drawn through the opening by the air emitted from the at least one outlet.

In a preferred embodiment an air flow is created through the nozzle of the fan assembly. In the following description this air flow will be referred to as the primary air flow. The primary air flow is emitted from the nozzle and preferably passes over a Coanda surface. The primary air flow entrains air surrounding the nozzle, which acts as an air amplifier to supply both the primary air flow and the entrained air to the user. The entrained air will be referred to here as a secondary air flow. The secondary air flow is drawn from the room space, region or external environment surrounding the nozzle and, by displacement, from other regions around the fan assembly, and passes predominantly through the opening defined by the nozzle. The primary air flow directed over the Coanda surface combined with the entrained secondary air flow equates to a total air flow emitted or projected forward from the opening defined by the nozzle.

The surface over which the primary air flow is directed preferably comprises a diffuser portion downstream from the at least one outlet. The diffuser portion may thus form part of a Coanda surface. The diffuser portion preferably extends about an axis, and preferably tapers towards or away from the axis.

The surface of the nozzle may also include a guide portion located downstream of the diffuser portion and angled thereto for channelling the combined air flow generated by the fan assembly. The guide portion is preferably tapered inwardly, that is, towards the axis, relative to the diffuser portion. The guide portion may itself taper towards or away from the axis. For example, the diffuser portion may taper away from the axis, and the guide portion may taper towards the axis. Alternatively, the diffuser portion may taper away from the axis, and the guide portion may be substantially cylindrical.

The surface of the nozzle may comprise a cutaway portion, with the second part of the nozzle being moveable to at least partially cover the cutaway portion. The surface may comprise a plurality of cutaway portions, with the second part of the nozzle being moveable to at least partially cover at least one of the cutaway portions. For example, the second part of the nozzle may be moveable relative to the surface to cover a selected one of the cutaway portions by a desired amount. Alternatively, the second part of the nozzle may be moveable to cover simultaneously each of the cutaway portions by a desired amount.

The cutaway portions may be regularly or irregularly spaced about the nozzle. The cutaway portions are preferably arranged in an annular array. The cutaway portions may have the same or different sizes and/or shapes. The, or each, cutaway portion may have any desired shape. In a preferred embodiment the, or each, cutaway portion has a shape which is generally arcuate, but the, or each, cutaway portion may be circular, oval, polygonal or irregular.

The, or each, cutaway portion may be located in the diffuser portion of the surface, or in the guide portion of the surface. The, or each, cutaway portion is preferably located at or towards a front edge of the nozzle. For example, the nozzle may comprise cutaway portions located on opposite sides of the guide portion. These cutaway portions may be located at side extremities of the nozzle, and/or at upper and lower extremities of the nozzle.

The second part of the nozzle may be generally annular in shape, and rotated relative to the Coanda surface by the user. This can allow one or more of the cutaway portions to be selectively covered. The inner surface of the second part of the nozzle preferably has substantially the same shape as the inner surface of the guide portion.

As an alternative to arranging the second part of the nozzle to cover cutaway portions of the surface of the nozzle, the second part of the nozzle may be moveable between a stowed position and at least one deployed position in which the second part of the nozzle is located downstream from the surface of the nozzle. In its stowed position, the second part of the nozzle may extend about the surface so that it is shielded from the combined air flow. As mentioned above, the second part of the nozzle may be located on an external surface of the nozzle, but alternatively the second part of the nozzle may be located within the nozzle when in its stowed position. The second part of the nozzle may then be pulled from the nozzle to move it from its stowed position to a deployed position. For example, a front part of the nozzle may comprise a slot from which the second part of the nozzle is pulled to withdraw the second part from the nozzle and into one of its deployed positions. A tab or other graspable member may be located on the second part to facilitate its withdrawal from the stowed position.

The second part of the nozzle may comprise a guide surface for changing the profile of the combined air flow. The guide surface may have a similar configuration to the guide portion discussed above. The guide surface may have a cylindrical or a frusto-conical shape. The guide surface preferably tapers inwardly relative to the surface of the nozzle. In the deployed position, the guide surface may converge inwardly in a direction extending away from the surface in order to focus the combined air flow towards a user located in front of the fan assembly.

As mentioned above, the second part of the nozzle is preferably generally annular in shape, and may be in the form of a hoop which is moveable relative to the other parts of the nozzle.

The nozzle is preferably in the form of a loop extending about the opening.

The nozzle may have a single outlet from which the primary air flow is emitted. Alternatively, the nozzle may comprise a plurality of outlets each for emitting a respective portion of the primary air flow. In this case, the outlets are preferably spaced about the opening. The nozzle preferably comprises a mouth for receiving the primary air flow, and for conveying the primary air flow to the outlet(s). The mouth preferably extends about the opening, more preferably continuously about the opening.

The spacing between opposing surfaces of the nozzle at the outlet(s) is preferably in the range from 0.5 mm to 5 mm. The nozzle preferably comprises an interior passage which extends about the opening, preferably continuously about the opening so that the opening is an enclosed opening which is surrounded by the interior passage.

The nozzle is preferably mounted on a base housing said system for creating an air flow. In the preferred fan assembly the system for creating an air flow through the nozzle comprises an impeller driven by a motor.

In a second aspect the present invention provides a fan assembly comprising a nozzle and a system for creating an air flow through the nozzle, the nozzle comprising an interior passage, at least one outlet for receiving at least a portion of the air flow from the interior passage, and a surface located adjacent said at least one outlet and over which said at least one outlet is arranged to direct said at least a portion of the air flow, characterized in that the nozzle has an adjustable configuration.

In a third aspect, the present invention provides a nozzle for a fan assembly, the nozzle comprising at least one outlet for emitting a primary air flow, and defining an opening through which a secondary air flow from outside the fan assembly is drawn by the primary air flow emitted from the at least one outlet, the nozzle comprising a first part and a second part which is moveable relative to the first part. The first part of the nozzle may be located upstream or downstream from the at least one outlet. The second part is preferably moveable relative to the first part between a stowed position in which it is shielded from the air flow and a deployed position in which it may be located downstream from the first part. Each part of the nozzle may comprise a surface over which the air flow is directed by said at least one outlet.

In a fourth aspect, the present invention provides a nozzle for a fan assembly, the nozzle comprising an interior passage, at least one outlet for receiving at least a portion of the air flow from the interior passage, and a surface located adjacent said at least one air outlet and over which said at least one outlet is arranged to direct said at least a portion of the air flow, characterized in that the nozzle has an adjustable configuration. The nozzle preferably comprises a moveable part which is moveable between a stowed position in which it is shielded from the air flow and a deployed position in which it is located downstream from the surface.

Features described above in connection with the first aspect of the invention are equally applicable to each of the second to fourth aspects of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
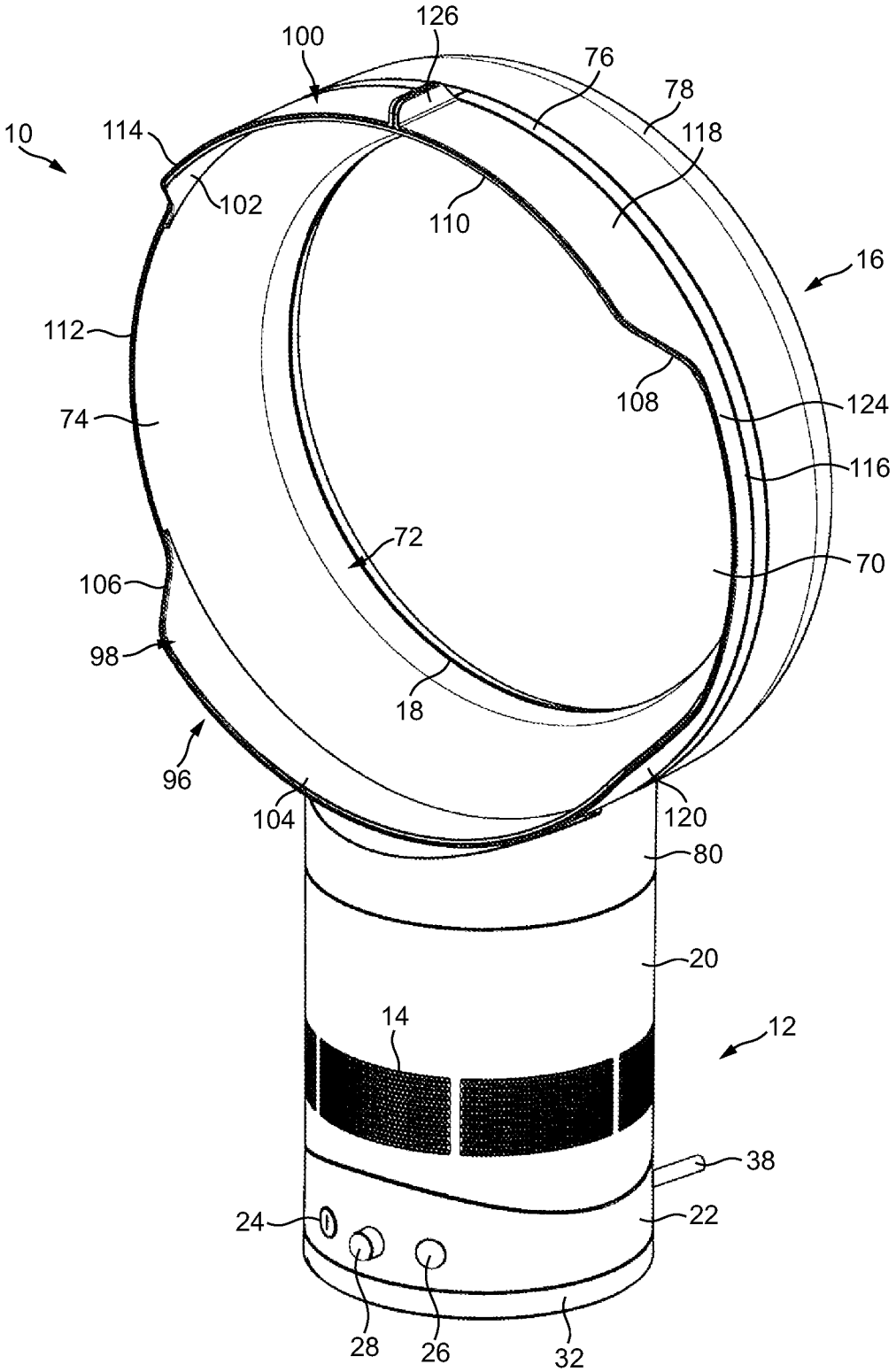
FIG. 1 is a front perspective view, from above, of a first fan assembly, with a nozzle of the fan assembly in a first configuration.
Figure 2:
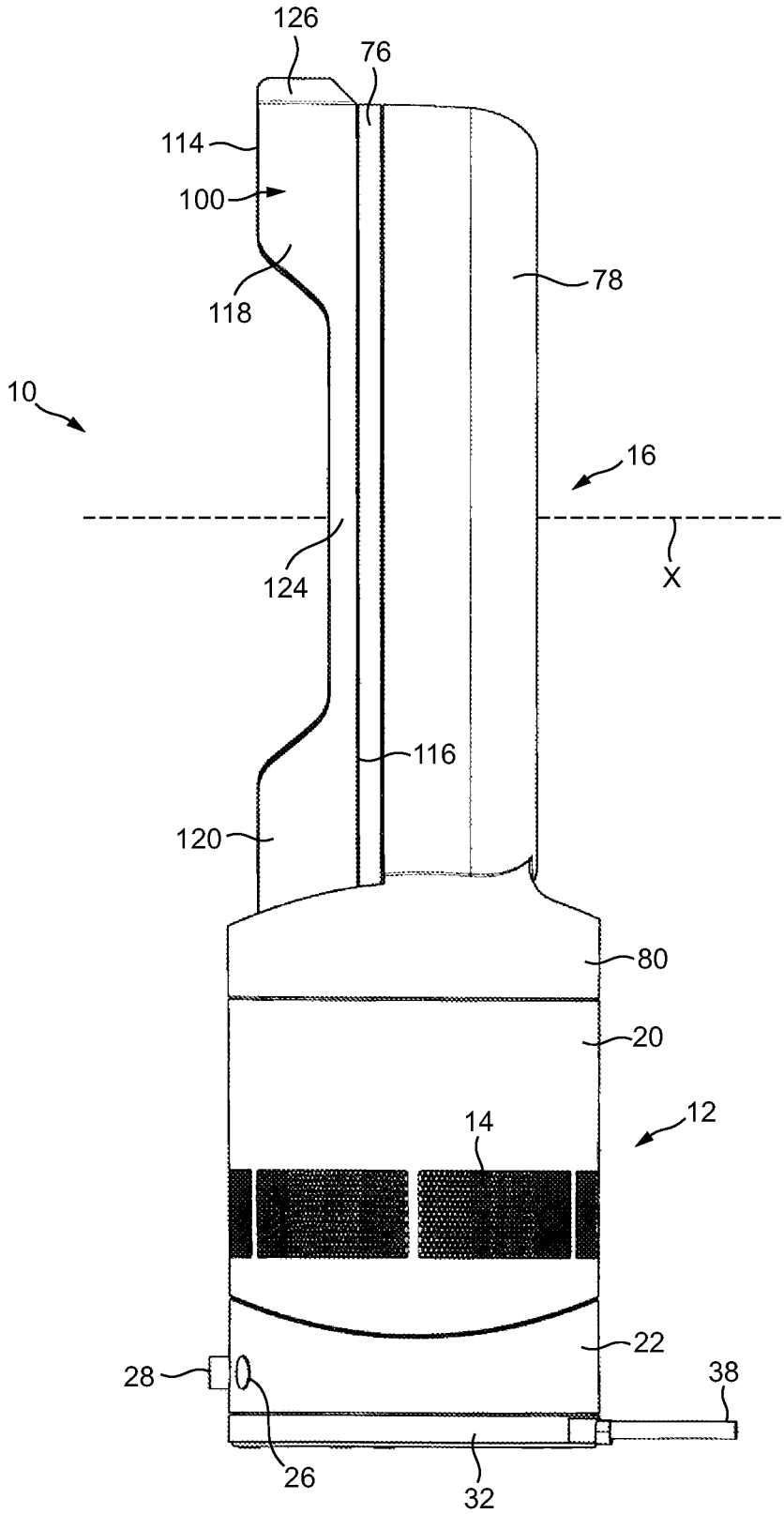
FIG. 2 is a left side view of the first fan assembly.
Figure 3:
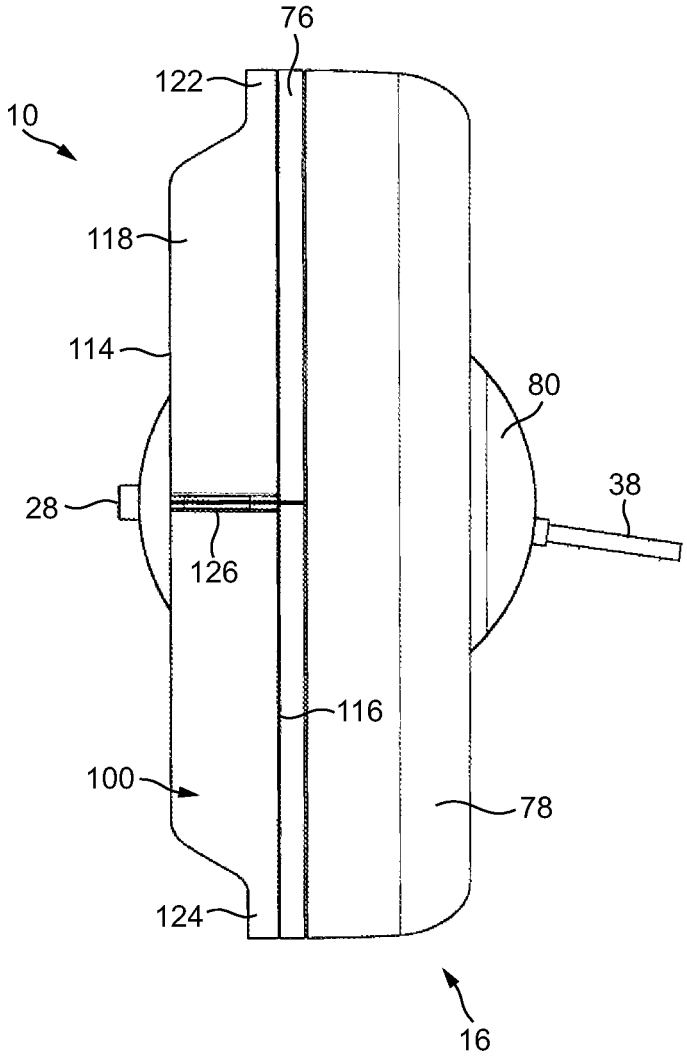
FIG. 3 is a top view of the first fan assembly.
Figure 4:
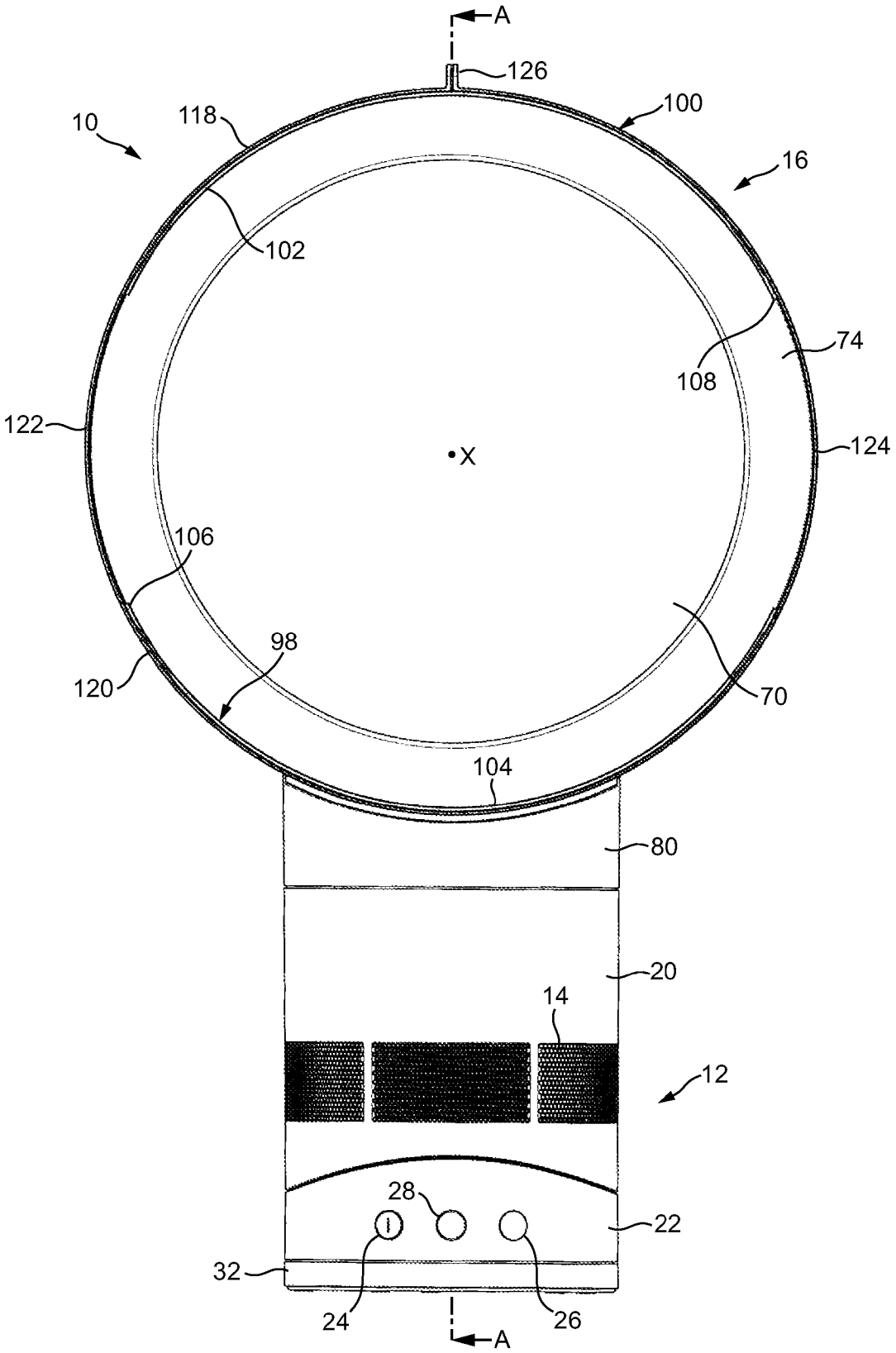
FIG. 4 is a front view of the first fan assembly.

FIGS. 1 to 4 are external views of a first fan assembly 10. The fan assembly 10 comprises a body 12 comprising an air inlet 14 through which a primary air flow enters the fan assembly 10, and a nozzle 16 in the form of an annular casing mounted on the body 12, and which comprises a mouth 18 having at least one outlet for emitting the primary air flow from the fan assembly 10.

The body 12 comprises a substantially cylindrical main body section 20 mounted on a substantially cylindrical lower body section 22. The main body section 20 and the lower body section 22 preferably have substantially the same external diameter so that the external surface of the upper body section 20 is substantially flush with the external surface of the lower body section 22. In this embodiment the body 12 has a height in the range from 100 to 300 mm, and a diameter in the range from 100 to 200 mm.

The main body section 20 comprises the air inlet 14 through which the primary air flow enters the fan assembly 10. In this embodiment the air inlet 14 comprises an array of apertures formed in the main body section 20. Alternatively, the air inlet 14 may comprise one or more grilles or meshes mounted within windows formed in the main body section 20. The main body section 20 is open at the upper end (as illustrated) thereof to provide an air outlet 23 through which the primary air flow is exhausted from the body 12.

The main body section 20 may be tilted relative to the lower body section 22 to adjust the direction in which the primary air flow is emitted from the fan assembly 10. For example, the upper surface of the lower body section 22 and the lower surface of the main body section 20 may be provided with interconnecting features which allow the main body section 20 to move relative to the lower body section 22 while preventing the main body section 20 from being lifted from the lower body section 22. For example, the lower body section 22 and the main body section 20 may comprise interlocking L-shaped members.

The lower body section 22 comprises a user interface of the fan assembly 10. The user interface comprises a plurality of user-operable buttons 24, 26, a dial 28 for enabling a user to control various functions of the fan assembly 10, and user interface control circuit 30 connected to the buttons 24, 26 and the dial 28. The lower body section 22 is mounted on a base 32 for engaging a surface on which the fan assembly 10 is located.

Figure 5:
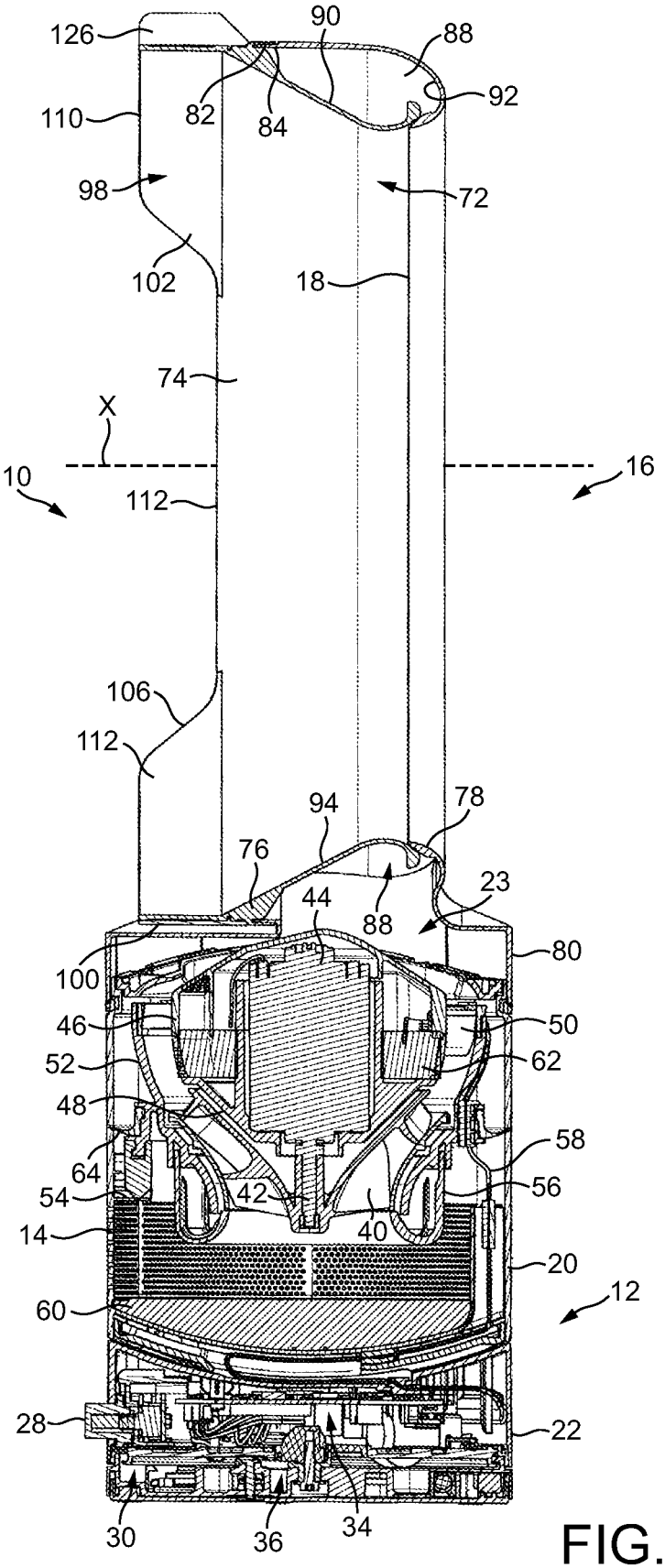
FIG. 5 is a side sectional view of the first fan assembly, taken along line A-A in FIG. 4.

FIG. 5 illustrates a sectional view through the body fan assembly. The lower body section 22 houses a main control circuit, indicated generally at 34, connected to the user interface control circuit 30. In response to operation of the buttons 24, 26 and the dial 28, the user interface control circuit 30 is arranged to transmit appropriate signals to the main control circuit 34 to control various operations of the fan assembly 10.

The lower body section 22 also houses a mechanism, indicated generally at 36, for oscillating the lower body section 22 relative to the base 32. The operation of the oscillating mechanism 36 is controlled by the main control circuit 34 in response to the user operation of the button 26. The range of each oscillation cycle of the lower body section 22 relative to the base 32 is preferably between 60° and 120°, and in this embodiment is around 80°. In this embodiment, the oscillating mechanism 36 is arranged to perform around 3 to 5 oscillation cycles per minute. A mains power cable 38 for supplying electrical power to the fan assembly 10 extends through an aperture formed in the base 32. The cable 38 is connected to a plug (not shown) for connection to a mains power supply.

The main body section 20 houses an impeller 40 for drawing the primary air flow through the air inlet 14 and into the body 12. Preferably, the impeller 40 is in the form of a mixed flow impeller. The impeller 40 is connected to a rotary shaft 42 extending outwardly from a motor 44. In this embodiment, the motor 44 is a DC brushless motor having a speed which is variable by the main control circuit 34 in response to user manipulation of the dial 28. The maximum speed of the motor 44 is preferably in the range from 5,000 to 10,000 rpm. The motor 44 is housed within a motor bucket comprising an upper portion 46 connected to a lower portion 48. The upper portion 46 of the motor bucket comprises a diffuser 50 in the form of a stationary disc having spiral blades.

The motor bucket is located within, and mounted on, a generally frusto-conical impeller housing 52. The impeller housing 52 is, in turn, mounted on a plurality of angularly spaced supports 54, in this example three supports, located within and connected to the main body section 20 of the base 12. The impeller 40 and the impeller housing 52 are shaped so that the impeller 40 is in close proximity to, but does not contact, the inner surface of the impeller housing 52. A substantially annular inlet member 56 is connected to the bottom of the impeller housing 52 for guiding the primary air flow into the impeller housing 52. An electrical cable 58 passes from the main control circuit 34 to the motor 44 through apertures formed in the main body section 20 and the lower body section 22 of the body 12, and in the impeller housing 52 and the motor bucket.

Preferably, the body 12 includes silencing foam for reducing noise emissions from the body 12. In this embodiment, the main body section 20 of the body 12 comprises a first foam member 60 located beneath the air inlet 14, and a second annular foam member 62 located within the motor bucket.

A flexible sealing member 64 is mounted on the impeller housing 52. The flexible sealing member prevents air from passing around the outer surface of the impeller housing 52 to the inlet member 56. The sealing member 64 preferably comprises an annular lip seal, preferably formed from rubber. The sealing member 64 further comprises a guide portion in the form of a grommet for guiding the electrical cable 58 to the motor 44.

Returning to FIGS. 1 to 4, the nozzle 16 has an annular shape, extending about a central axis X to define an opening 70. The mouth 18 is located towards the rear of the nozzle 16, and is arranged to emit the primary air flow towards the front of the fan assembly 10, through the opening 70. The mouth 18 surrounds the opening 70. In this example, the nozzle 16 defines a generally circular opening 70 located in a plane which is generally orthogonal to the central axis X. The innermost, external surface of the nozzle 16 comprises a Coanda surface 72 located adjacent the mouth 18, and over which the mouth 18 is arranged to direct the air emitted from the fan assembly 10. The Coanda surface 72 comprises a diffuser portion 74 tapering away from the central axis X. In this example, the diffuser portion 74 is in the form of a generally frusto-conical surface extending about the axis X, and which is inclined to the axis X at an angle in the range from 5 to 35°, and in this example is around 28°.

The nozzle 16 comprises an annular front casing section 76 connected to and extending about an annular rear casing section 78. The annular sections 76, 78 of the nozzle 16 extend about the central axis X. Each of these sections may be formed from a plurality of connected parts, but in this embodiment each of the front casing section 76 and the rear casing section 78 is formed from a respective, single molded part. The rear casing section 78 comprises a base 80 which is connected to the open upper end of the main body section 20 of the body 12, and which has an open lower end for receiving the primary air flow from the body 12.

With reference also to FIG. 5, during assembly, the front end 82 of the rear casing section 78 is inserted into a slot 84 located in the front casing section 76. Each of the front end 82 and the slot 84 is generally cylindrical. The casing sections 76, 78 may be connected together using an adhesive introduced to the slot 84.

The front casing section 76 defines the Coanda surface 72 of the nozzle 16. The front casing section 76 and the rear casing section 78 together define an annular interior passage 88 for conveying the primary air flow to the mouth 18. The interior passage 88 extends about the axis X, and is bounded by the internal surface 90 of the front casing section 76 and the internal surface 92 of the rear casing section 78. The base 80 of the front casing section 76 is shaped to convey the primary air flow into the interior passage 88 of the nozzle 16.

The mouth 18 is defined by overlapping, or facing, portions of the internal surface 92 of the rear casing section 78 and the external surface 94 of the front casing section 76, respectively. The mouth 18 preferably comprises an air outlet in the form of an annular slot. The slot is preferably generally circular in shape, and preferably has a relatively constant width in the range from 0.5 to 5 mm. In this example the air outlet has a width of around 1 mm. Spacers may be spaced about the mouth 18 for urging apart the overlapping portions of the front casing section 76 and the rear casing section 78 to control the width of the air outlet of the mouth 18. These spacers may be integral with either the front casing section 76 or the rear casing section 78. The mouth 18 is shaped to direct the primary air flow over the external surface 94 of the front casing section 76.

The external surface of the nozzle 16 also comprises a guide portion 96 located downstream from the diffuser portion 74 and angled thereto. The guide portion 96 similarly extends about the axis X. The guide portion 96 may be inclined to the axis X by an angle in the range from −30 to 30°, but in this example the guide portion 96 is generally cylindrical and is centered on the axis X. The depth of the guide portion 96, as measured along the axis X, is preferably in the range from 20 to 80% of the depth of the diffuser portion 74, and in this example is around 60%.

The guide portion 96 comprises a first section 98 which is connected to, and preferably integral with, the diffuser portion 74 of the Coanda surface 72, and a second section 100 which is moveable relative to the first section 98 to adjust a parameter of the air flow generated by the fan assembly 10. In this example, the first section 98 of the guide portion 96 of the nozzle 16 comprises an upper portion 102 and a lower portion 104. Each of the upper portion 102 and the lower portion 104 is in the form of a partially cylindrical surface centered on the axis X, and which extends about the axis X by an angle which is preferably in the range from 30 to 150°, and in this example is around 120°. The upper and lower portions 102, 104 are separated by a pair of cutaway portions 106, 108 of the first section 98. In this example each cutaway portion 106, 108 is located at a respective side of the first section 98, and extends from the front edge 110 of the first section 98 to the substantially circular front edge 112 of the diffuser portion 74. The cutaway portions 106, 108 have generally the same size and shape, and in this example each extend around 60° about the axis X.

The second section 100 of the guide portion 96 is generally annular in shape, and is mounted on the external surface of the nozzle 16 so as to extend about the first section 98 of the guide portion 96. The second section 100 has a generally cylindrical curvature, and is also centered on the axis X. The front edge 114 of the second section 100 is substantially co-planar with the front edge 110 of the first section 98, whereas the substantially circular rear edge 116 is located rearwardly of the first section 96 so as to surround the diffuser portion 74 of the Coanda surface 72.

The depth of the second section 100 of the guide portion 96, as measured along the axis X, varies about the axis X. The second section 100 comprises two forwardly extending portions 118, 120 which are connected by arcuate connectors 122, 124. The forwardly extending portions 118, 120 of the second section 100 have generally the same size and shape as the upper and lower portions 102, 104 of the front section 98. The connectors 122, 124 are relatively narrow, and are located behind the front edge 112 of the diffuser portion 74 of the Coanda surface 72 so that these connectors 122, 124 are not exposed to the air flow generated by the fan assembly 10.

As mentioned above, the second section 100 of the guide portion 96 is moveable relative to the first section 98 of the guide portion 96. In this example, the second section 100 is located about the first section 98 so as to be rotatable about the axis X. The second section 100 comprises a pair of tabs 126 which extend radially outwardly to allow a user to grip the tabs to rotate the second section 100 relative to the first section 98. In this example, the second section 100 slides over the first section 98 as it is moved relative thereto. The inner surface of the second section 100 may comprise a radially inwardly extending ridge, which may extend partially or fully about the axis X, which is received within an annular groove formed on the outer surface of the front casing section 76 and which guides the movement of the second section 100 relative to the first section 98.

To operate the fan assembly 10 the user the user presses button 24 of the user interface. The user interface control circuit 30 communicates this action to the main control circuit 34, in response to which the main control circuit 34 activates the motor 44 to rotate the impeller 40. The rotation of the impeller 40 causes a primary air flow to be drawn into the body 12 through the air inlet 14. The user may control the speed of the motor 44, and therefore the rate at which air is drawn into the body 12 through the air inlet 14, by manipulating the dial 28 of the user interface. Depending on the speed of the motor 44, the primary air flow generated by the impeller 40 may be between 10 and 30 liters per second. The primary air flow passes sequentially through the impeller housing 52 and the air outlet 23 at the open upper end of the main body portion 20 to enter the interior passage 88 of the nozzle 16. The pressure of the primary air flow at the air outlet 23 of the body 12 may be at least 150 Pa, and is preferably in the range from 250 to 1.5 kPa.

Within the interior passage 88 of the nozzle 16, the primary air flow is divided into two air streams which pass in opposite directions around the opening 70 of the nozzle 16. As the air streams pass through the interior passage 70, air is emitted through the mouth 18. The primary air flow emitted from the mouth 18 is directed over the Coanda surface 72 of the nozzle 16, causing a secondary air flow to be generated by the entrainment of air from the external environment, specifically from the region around the mouth 18 and from around the rear of the nozzle 16. This secondary air flow passes through the central opening 70 of the nozzle 16, where it combines with the primary air flow to produce a combined, or total, air flow, or air current, projected forward from the nozzle 16.

As part of the nozzle 16, in this example the second section 100 of the guide portion 96 of the nozzle 16, is moveable relative to the remainder of the nozzle 16, the nozzle 16 may adopt one of a number of different configurations. FIGS. 1 to 5 illustrate the nozzle 16 in a first configuration, in which the second section 100 of the guide portion 96 is in a stowed position relative to the other parts of the nozzle 16. In this stowed position the forwardly extending portions 118, 120 of the second section 100 are located radially behind the upper and lower portions 102, 104 of the front section 98 so that the second section 100 is substantially fully shielded from the air flow. This allows part of the combined air flow to pass through the cutaway portions 106, 108 of the first section 96 without being channelled or focussed towards the axis X by the guide portion 96 of the nozzle 16.

As the angle of the diffuser portion 74 of the Coanda surface 72 is relatively wide, in this example around 28°, the profile of the combined air flow projected forward from the fan assembly 10 will be relatively wide. However, in view of the partial guiding of the combined air flow towards the axis X, the profile of the air current generated by the fan assembly 10 is non-circular. The profile is generally oval, with the height of the profile being smaller than the width of the profile. This flattening, or widening, of the profile of the air current in this nozzle configuration can make the fan assembly 10 particularly suitable for use as a desk fan in a room, office or other environment to deliver a cooling air current simultaneously to a number of users in proximity to the fan assembly 10.

Figure 6:
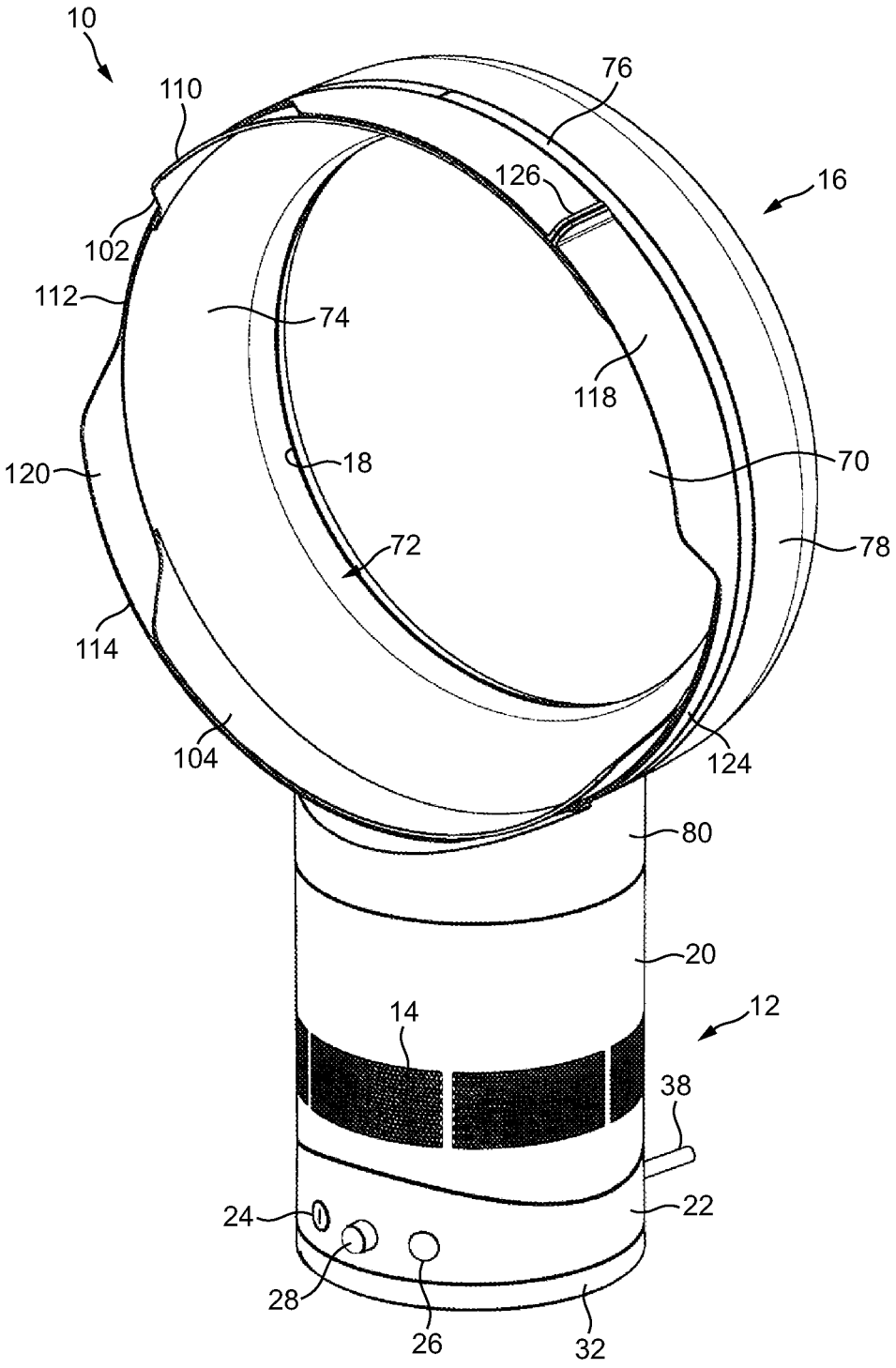
FIG. 6 is a front perspective view, from above, of the first fan assembly, with the nozzle in a second configuration.

By gripping the tabs 126 of the second section 100 of the guide portion 96, a user may rotate the second section 100 relative to the first section 98 to change the configuration of the nozzle 16. FIG. 6 illustrates the fan assembly 10 in a second configuration in which the second section 100 is in a partially deployed position relative to the other parts of the nozzle 16 following a partial rotation of the second section 100 about the first section 98. In this partially deployed position, the forwardly extending portions 118, 120 of the second section 100 partially cover the cutaway portions 106, 108 of the first section 96, changing the profile of the combined air and increasing the proportion of the combined air flow which is channelled towards a user located in front of the fan assembly 10.

Figure 7:
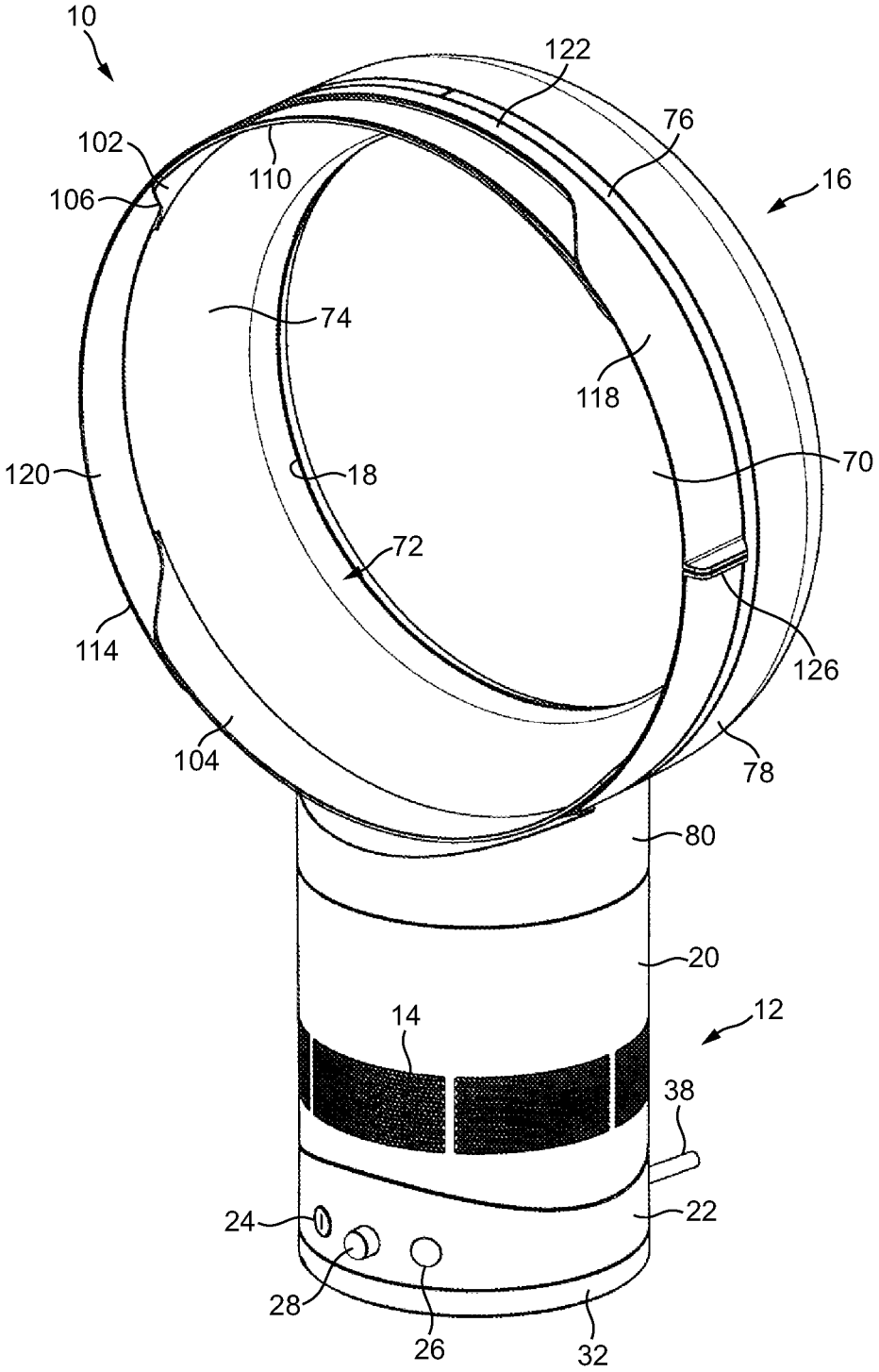
FIG. 7 is a front perspective view, from above, of the first fan assembly, with the nozzle in a third configuration.

FIG. 7 illustrates the fan assembly 10 in a third configuration in which the second section 100 is in a fully deployed position relative to the other parts of the nozzle 16 following a further partial rotation of the second section 100 about the first section 98. In this fully deployed position, the forwardly extending portions 118, 120 of the second section 100 cover fully the cutaway portions 106, 108 of the first section 96, again changing the profile of the combined air so that all of the combined air flow is channelled towards a user located in front of the fan assembly 10. The upper and lower portions 102, 104 of the front section 98 and the forwardly extending portions 118, 120 of the second section 100 provide a substantially continuous, substantially cylindrical guide surface for channelling the combined air flow towards the user, and so the profile of the combined air flow, in this nozzle configuration, is generally circular. This focussing of the profile of the air flow can make the fan assembly 10 particularly suitable for use as a desk fan in a room, office or other environment to deliver a cooling air current to a single user in proximity to the fan assembly 10.

The movement of the nozzle 16 between these configurations also varies the flow rate and the velocity of the combined air flow generated by the fan assembly 10. When the second section 100 is in the stowed position, the combined air flow has a relatively high flow rate but a relatively low velocity. When the second section 100 is in the fully deployed position, the combined air flow has a relatively low flow rate but a relatively high velocity.

As an alternative to locating the portions 102, 104 of the front section 98 at the upper and lower extremities of the guide portion 96, these portions may be located at the side extremities of the guide portion 96. Thus, when the second section 100 is in its stowed position, the height of the profile of the air current may be greater than the width of the profile. This stretching of the profile of the air current in a vertical direction can make the fan assembly particularly suitable for use as a floor standing tower or pedestal fan.

Figure 8:
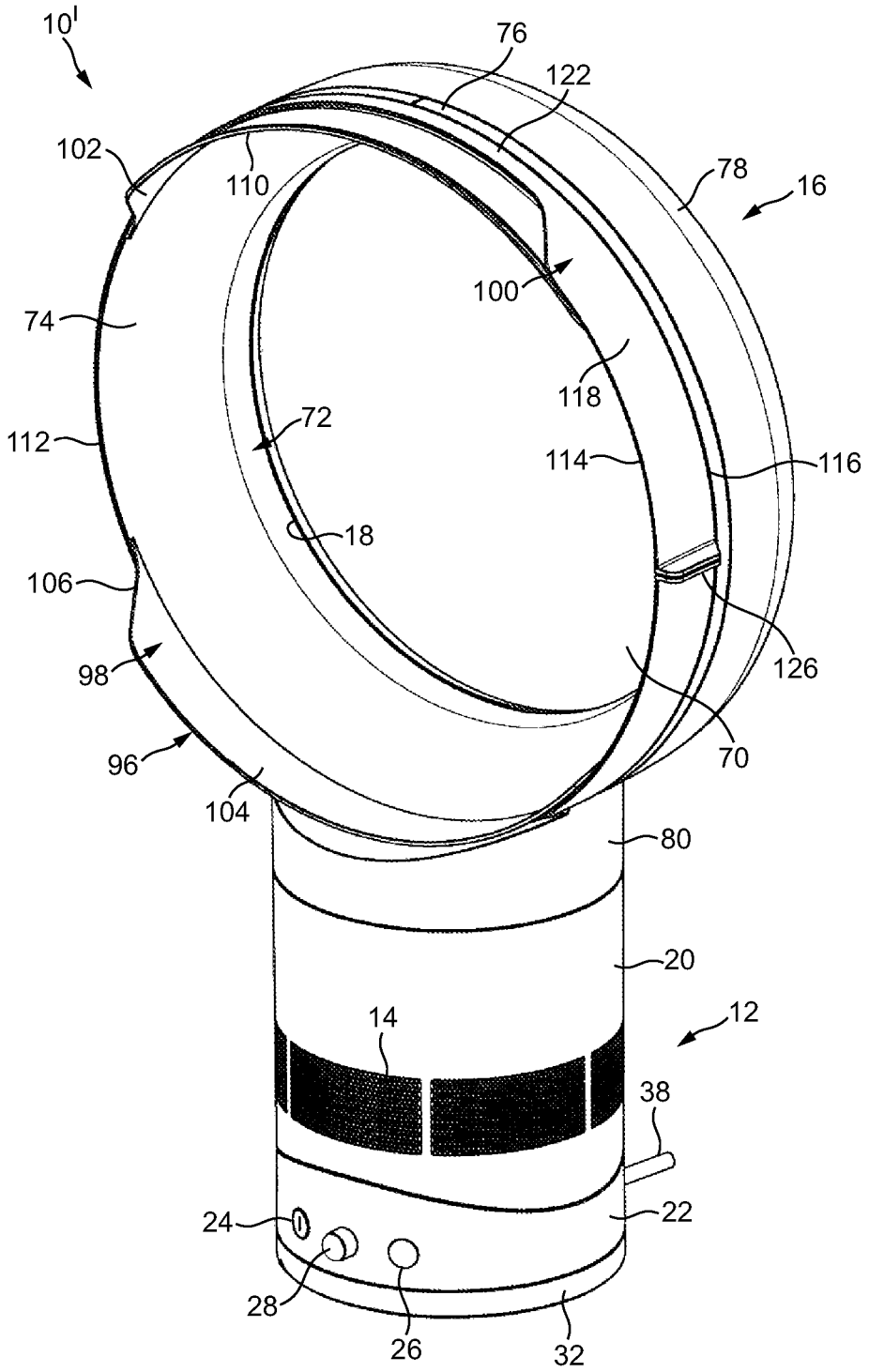
FIG. 8 is a front perspective view, from above, of a second fan assembly, with a nozzle of the fan assembly in a first configuration.
Figure 9:
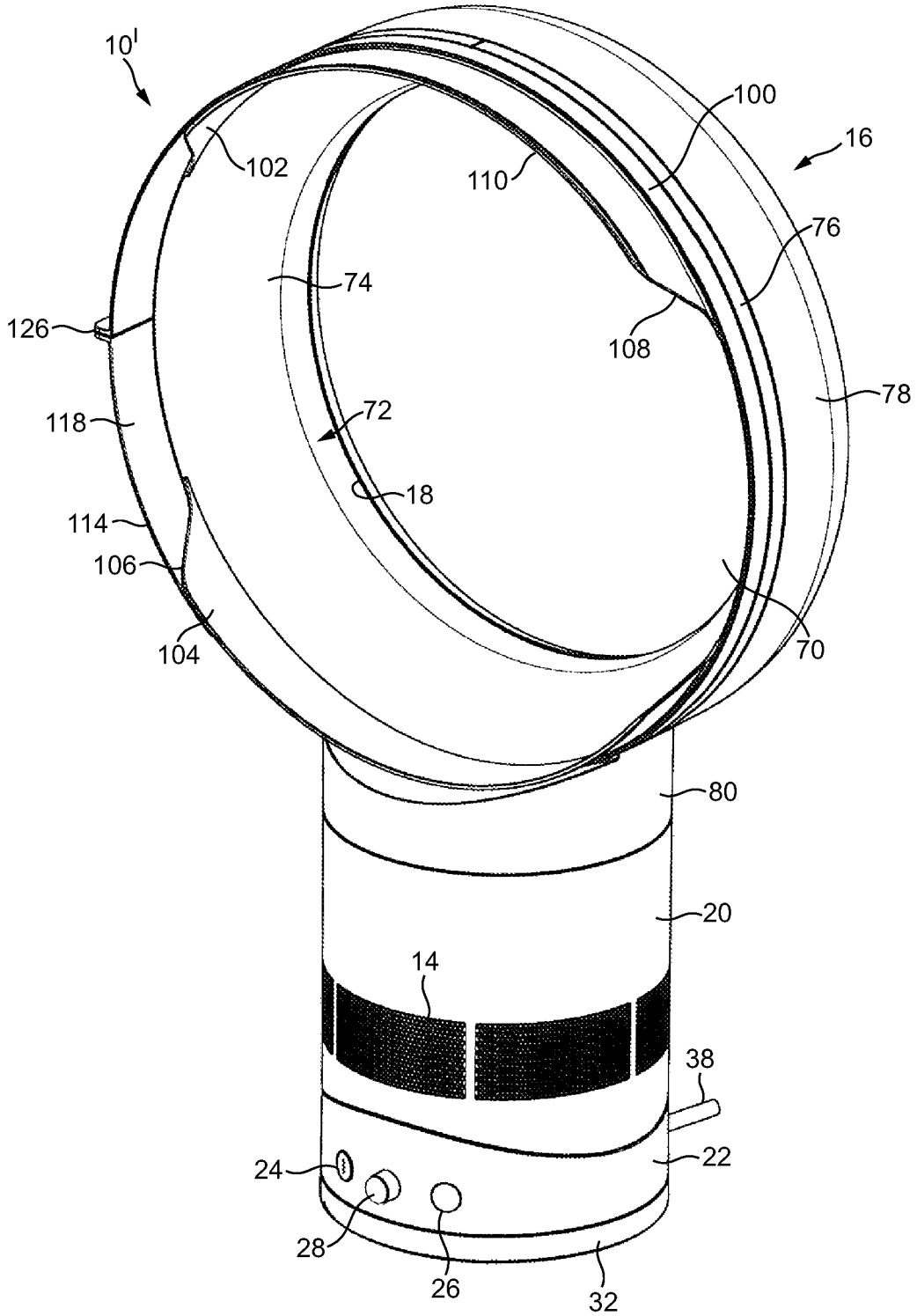
FIG. 9 is a front perspective view, from above, of the second fan assembly, with the nozzle in a second configuration.

In the fan assembly 10, the second section 100 is arranged to cover simultaneously both of the cutaway portions 106, 108 when in its fully deployed position. FIGS. 8 and 9 illustrate a second fan assembly 10', which differs from the fan assembly 10 in that the forwardly extending portion 120 has been omitted from the second section 100 of the guide portion 96. In view of this, the second section 100 is moveable from a stowed position in which, similar to the fan assembly 10, air can flow through both of the cutaway portions 106, 108 of the first section 98, to one of a first fully deployed position and a second fully deployed position. In the first fully deployed position, illustrated in FIG. 8, only the cutaway portion 108 is covered fully by the second section 100 whereas in the second fully deployed position, illustrated in FIG. 9, only the cutaway portion 106 is covered fully by the second section 100. The movement of the second section 100 between these fully deployed positions thus not only changes the profile of the combined air flow, but also changes the direction and the orientation of the combined air flow.

In this example, the change in the orientation of the combined air flow between the first and second fully deployed positions is around 180°. Thus, the movement of the nozzle 16 between these two configurations, in which the second section 100 is in the first fully deployed position and the second fully deployed position respectively, can produce an effect which is similar to that produced by oscillating the lower body section 22 relative to the base 32, that is, a sweeping of the combined air flow over an arc during the use of the fan assembly 10'. Mechanizing the movement of the second section 100 relative to the first section 98 can thus provide an alternative means of sweeping the combined air flow over an arc.

FIGS. 10 to 13 illustrate a third fan assembly 200. The fan assembly 200 comprises a body 12 comprising an air inlet 14 through which a primary air flow enters the fan assembly 200. The base 12 of the fan assembly 200 is the same as that of the first fan assembly 10. The fan assembly 200 further comprises a nozzle 202 in the form of an annular casing mounted on the body 12, and which comprises a mouth 204 having at least one outlet for emitting the primary air flow from the fan assembly 10. Similar to the nozzle 16, the nozzle 202 has an annular shape, extending about a central axis X to define an opening 206. The mouth 204 is located towards the rear of the nozzle 202, and is arranged to emit the primary air flow towards the front of the fan assembly 200, through the opening 206. The mouth 204 surrounds the opening 206. In this example, the nozzle 202 defines a generally circular opening 206 located in a plane which is generally orthogonal to the central axis X. The innermost, external surface of the nozzle 202 comprises a Coanda surface 208 located adjacent the mouth 204, and over which the mouth 204 is arranged to direct the air emitted from the nozzle 16. The Coanda surface 208 comprises a diffuser portion 210 tapering away from the central axis X. In this example, the diffuser portion 210 is in the form of a generally frusto-conical surface extending about the axis X, and which is inclined to the axis X at an angle in the range from 5 to 35°, and in this example is around 20°.

The nozzle 202 comprises an annular front casing section 212 connected to and extending about an annular rear casing section 214. The annular sections 212, 214 of the nozzle 202 extend about the central axis X. Each of these sections may be formed from a plurality of connected parts, but in this embodiment each of the front casing section 212 and the rear casing section 214 is formed from a respective, single molded part. The rear casing section 214 comprises a base 216 which is connected to the open upper end of the main body section 20 of the body 12, and which has an open lower end for receiving the primary air flow from the body 12. As with the nozzle 16 of the fan assembly 10, during assembly the front end of the rear casing section 214 is inserted into a slot located in the front casing section 212. The casing sections 212, 214 may be connected together using an adhesive introduced to the slot.

The front casing section 212 defines the Coanda surface 208 of the nozzle 202. The front casing section 212 and the rear casing section 214 together define an annular interior passage 218 for conveying the primary air flow to the mouth 204. The interior passage 218 extends about the axis X, and is bounded by the internal surface 220 of the front casing section 212 and the internal surface 222 of the rear casing section 214. The base 216 of the front casing section 212 is shaped to convey the primary air flow into the interior passage 218 of the nozzle 202.

The mouth 204 is defined by overlapping, or facing, portions of the internal surface 222 of the rear casing section 214 and the external surface 224 of the front casing section 212, respectively. The mouth 204 preferably comprises an air outlet in the form of an annular slot. The air outlet is preferably generally circular in shape, and preferably has a relatively constant width in the range from 0.5 to 5 mm. In this example the air outlet has a width of around 1 mm. Spacers may be spaced about the mouth 204 for urging apart the overlapping portions of the front casing section 212 and the rear casing section 214 to control the width of the air outlet of the mouth 204. These spacers may be integral with either the front casing section 212 or the rear casing section 214. The mouth 204 is shaped to direct the primary air flow over the external surface 224 of the front casing section 212.

The nozzle 202 further comprises a guide surface 226. The guide surface 226 extends about the axis X, and is angled relative to the diffuser portion 210 of the Coanda surface 208. The guide surface 226 may be inclined to the axis X by an angle in the range from −30 to 30°, but in this example the guide surface 226 is generally cylindrical and is centered on the axis X. The depth of the guide surface 226, as measured along the axis X, is preferably in the range from 20 to 80% of the depth of the diffuser portion 210, and in this example is around 50%.

The guide surface 226 is moveable relative to the diffuser portion 210 of the Coanda surface 208 to adjust a parameter of the air flow generated by the fan assembly 10. In this fan assembly 200, the guide surface 226 is mounted on the external surface of the nozzle 202 so as to be rotatable about the axis X. The guide surface 226 comprises a pair of tabs 228 which extend radially outwardly from the outer surface of the guide surface 226 to allow a user to grip the tabs 228 to rotate the guide surface 226 relative to the diffuser portion 210. In this example, the guide surface 226 slides over the outer surface of the nozzle 16 as it is moved by the user.

The inner surface of the guide surface 226 comprises a plurality of helical grooves 230 which each receive a respective helical ridge 232 which extends outwardly from the outer surface of the nozzle. The engagement between the groves 230 and the ridges 232 guides the movement of the guide surface 226 relative to the diffuser portion 210 so that as the guide surface 226 is rotated relative to the nozzle 202, it moves along the axis X.

As an alternative to providing helical grooves 230 and ridges 232, the grooves 230 and ridges 232 may each extend substantially parallel to the axis X. In this case, the guide surface 226 may be pulled over the external surface of the nozzle 202 to move the guide surface 226 relative to the diffuser portion 210.

Figure 10:
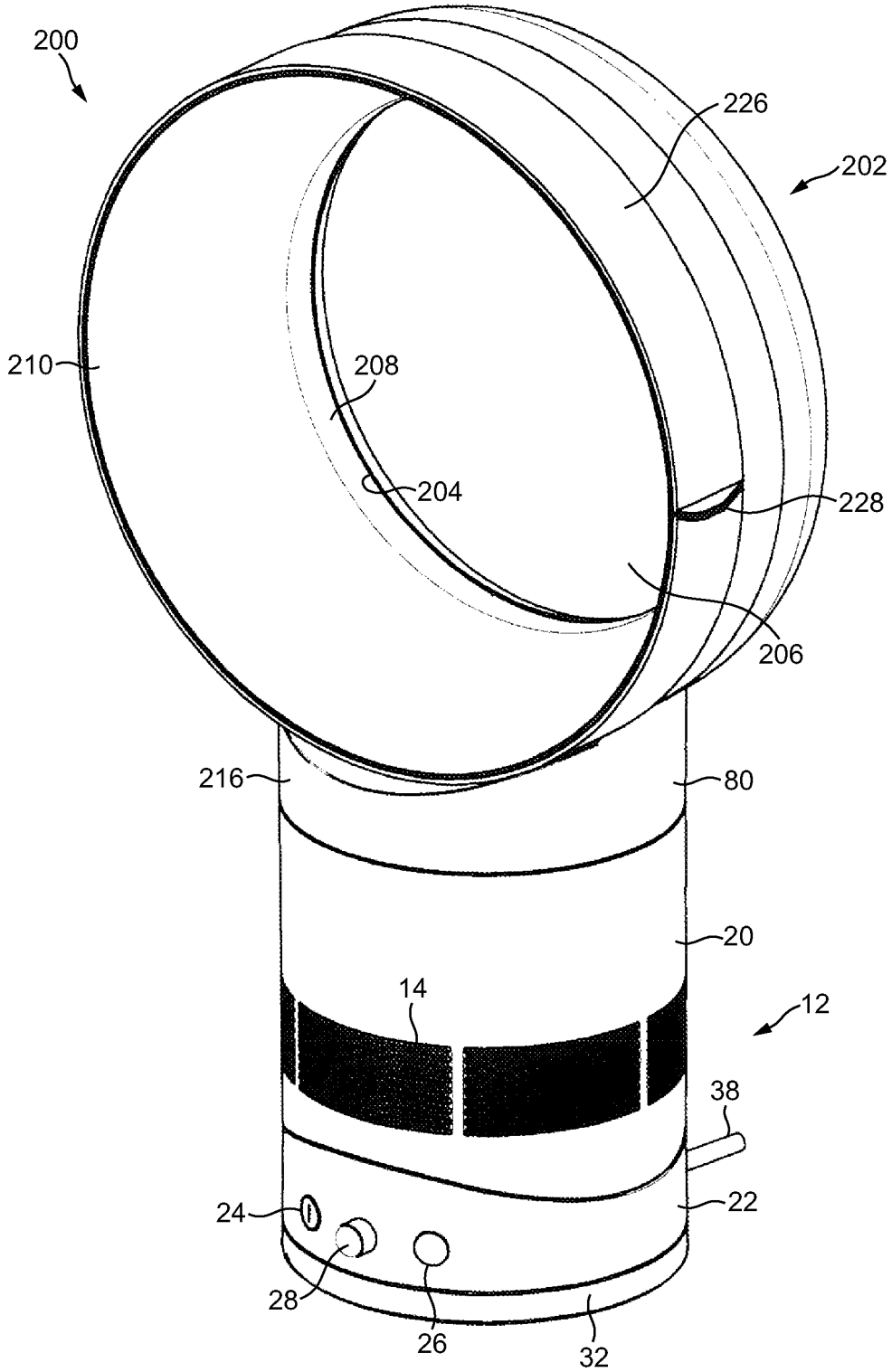
FIG. 10 is a front perspective view, from above, of a third fan assembly, with a nozzle of the fan assembly in a first configuration.
Figure 11:
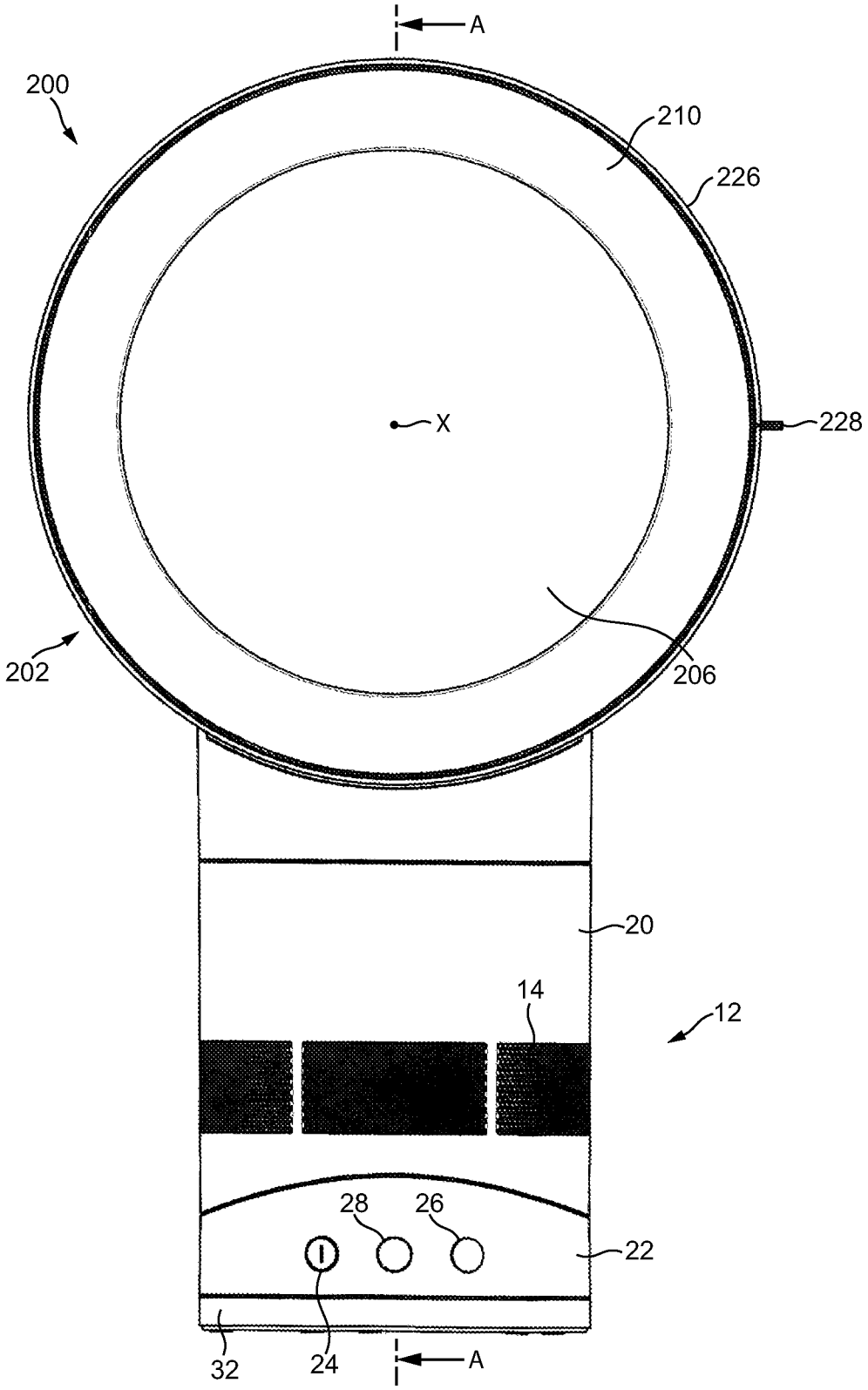
FIG. 11 is a front view of the third fan assembly.
Figure 12:
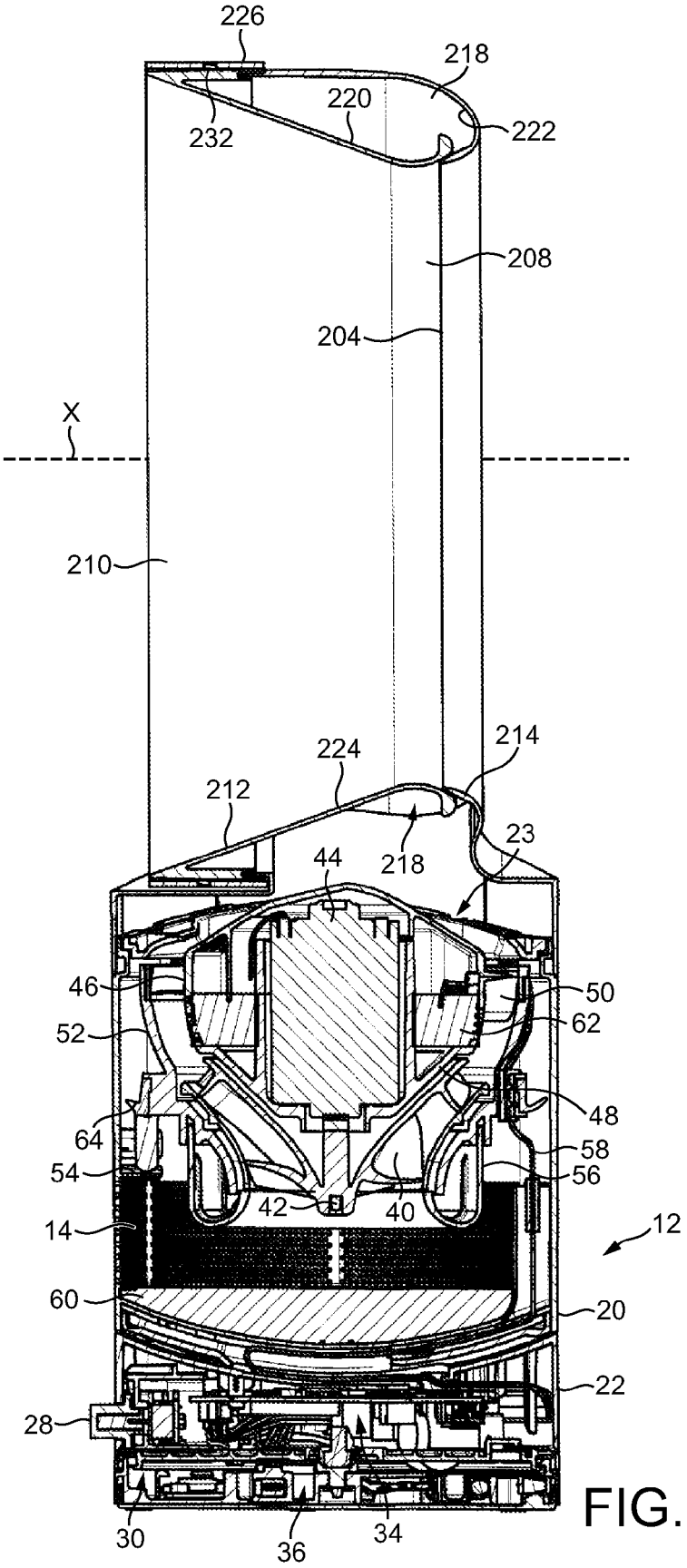
FIG. 12 is a side sectional view of the third fan assembly, taken along line A-A in FIG. 11.

The guide surface 226 is moveable relative to the diffuser portion 210 between a stowed position and a deployed position to adjust the configuration of the nozzle 202. FIGS. 10 to 12 illustrate the fan assembly 200 in a first configuration, in which the guide surface 226 is in its stowed position. In this position, the guide surface 226 is located substantially fully about the outer surface of the nozzle 202 so that it is shielded from the primary air flow emitted from the air outlet of the nozzle 202 during use of the fan assembly 200. In this configuration of the nozzle 202, the portion of the combined air flow which passes through the opening 206 of the nozzle 202 is not channelled or focussed towards the axis X by the guide surface 226 of the nozzle 16, and so the air combined flow has a relatively wide profile. In this configuration, the fan assembly 200 is particularly suitable for use as a desk fan in a room, office or other environment to deliver a cooling air current simultaneously to a number of users in proximity to the fan assembly 200. When the guide surface 226 is in the stowed position, the combined air flow generated by the fan assembly 200 has a relatively high flow rate but a relatively low velocity.

Figure 13:
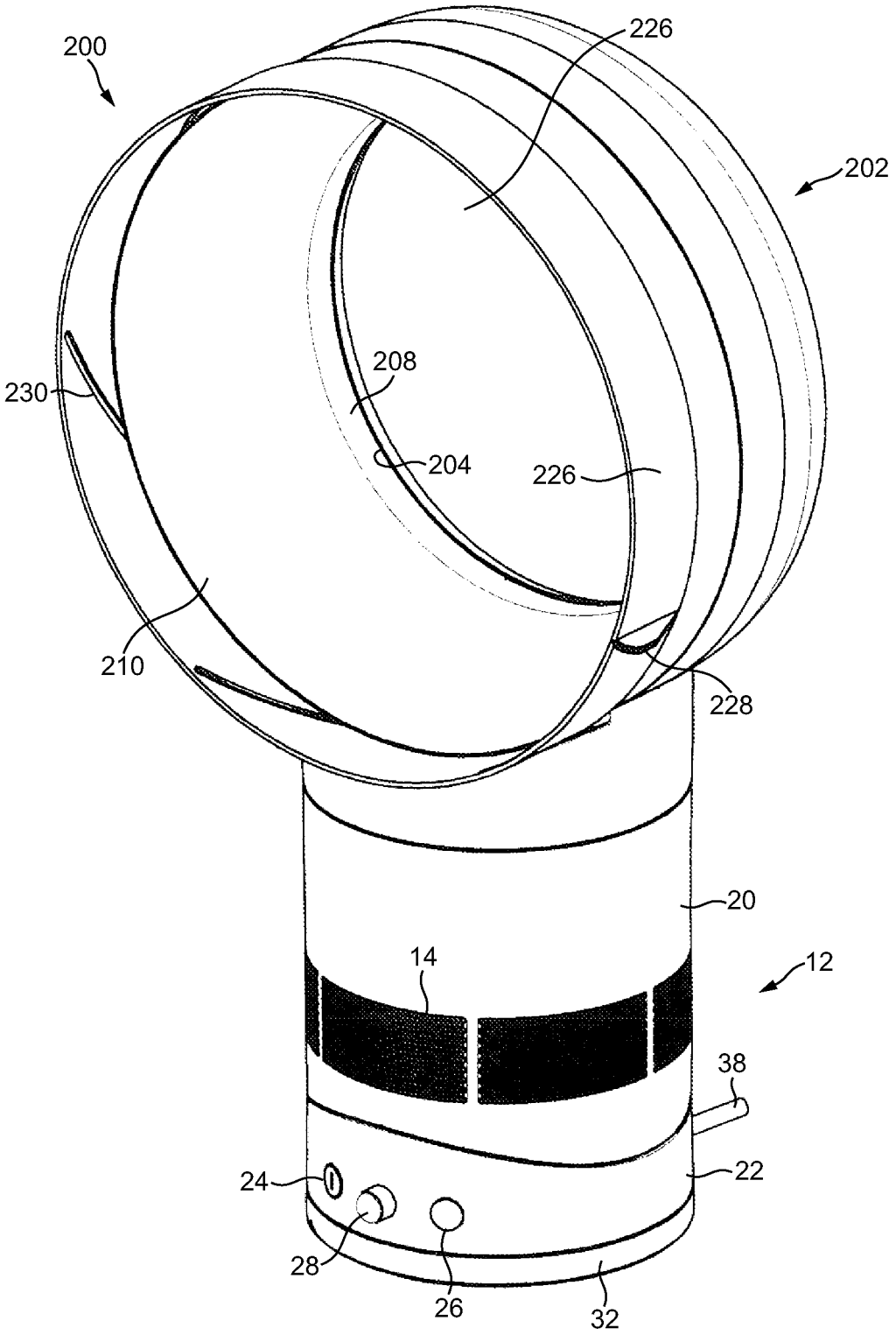
FIG. 13 is a front perspective view, from above, of the third fan assembly, with the nozzle in a second configuration.

By gripping the tabs 228 of the guide surface 226, a user may rotate the guide surface 226 to move the guide surface 226 along the axis X, and thereby change the configuration of the nozzle 202. FIG. 13 illustrates the fan assembly 200 in a second configuration, in which the guide surface 226 is in a deployed position. In this deployed position, the guide surface 226 is located downstream from the diffuser portion 210 of the Coanda surface 208. During use of the fan assembly 200, the portion of the combined air flow which passes through the opening 206 of the nozzle 202 is now channelled or focussed towards the axis X by the guide surface 226 of the nozzle 202, and so the combined air flow now has a relatively narrow profile. This focussing of the profile of the air flow can make the fan assembly 200 particularly suitable for use as a desk fan in a room, office or other environment to deliver a cooling air current to a single user in proximity to the fan assembly 200. When the guide surface 226 is in the fully deployed position, the combined air flow has a relatively low flow rate but a relatively high velocity.

FIGS. 14 to 17 illustrate a fourth fan assembly 300. Again, the fan assembly 300 comprises a body 12 comprising an air inlet 14 through which a primary air flow enters the fan assembly 300. The base 12 of the fan assembly 300 is the same as that of the first fan assembly 10. The fan assembly 300 further comprises a nozzle 302 in the form of an annular casing mounted on the body 12, and which comprises a mouth 304 having at least one outlet for emitting the primary air flow from the fan assembly 10. Similar to the nozzle 16, the nozzle 302 has an annular shape, extending about a central axis X to define an opening 306. The mouth 304 is located towards the rear of the nozzle 302, and is arranged to emit the primary air flow towards the front of the fan assembly 300, through the opening 306. Again, the mouth 304 surrounds the opening 306. In this example, the nozzle 302 defines a generally circular opening 306 located in a plane which is generally orthogonal to the central axis X.

The innermost, external surface of the nozzle 302 comprises a Coanda surface 308 located adjacent the mouth 304, and over which the mouth 304 is arranged to direct the air emitted from the nozzle 16. The Coanda surface 308 comprises a diffuser portion 310 tapering away from the central axis X. In this example, the diffuser portion 310 is in the form of a generally frusto-conical surface extending about the axis X, and which is inclined to the axis X at an angle in the range from 5 to 35°, and in this example is around 20°.

The nozzle 302 comprises an annular front casing section 312 connected to an annular rear casing section 314. The annular sections 312, 314 of the nozzle 302 extend about the central axis X. Each of these sections may be formed from a single component or a plurality of connected parts. In this embodiment, the front casing section 312 is integral with the rear casing section 314. The rear casing section 314 comprises a base 316 which is connected to the open upper end of the main body section 20 of the body 12, and which has an open lower end for receiving the primary air flow from the body 12. The front casing section 312 defines the Coanda surface 308 of the nozzle 302. The front casing section 312 and the rear casing section 314 together define an annular interior passage 318 for conveying the primary air flow to the mouth 304. The interior passage 318 extends about the axis X, and is bounded by the internal surface 320 of the front casing section 312 and the internal surface 322 of the rear casing section 314. The base 316 of the front casing section 312 is shaped to convey the primary air flow into the interior passage 318 of the nozzle 302.

The mouth 304 is defined by overlapping, or facing, portions of the internal surface 322 of the rear casing section 314 and the external surface 324 of the front casing section 312, respectively. The mouth 304 is shaped to direct the primary air flow over the external surface 324 of the front casing section 312. The mouth 304 preferably comprises an air outlet in the form of an annular slot. The air outlet is preferably generally circular in shape, and preferably has a relatively constant width in the range from 0.5 to 5 mm. In this example the air outlet has a width of around 1 mm. Where the front casing section 312 and the rear casing section 314 are formed from separate components, spacers may be spaced about the mouth 304 for urging apart the overlapping portions of the front casing section 312 and the rear casing section 314 to control the width of the air outlet of the mouth 304. These spacers may be integral with either the front casing section 312 or the rear casing section 314. Where the front casing section 312 is integral with the rear casing section 314, the nozzle 302 may be formed with a series of fins which are spaced about, and extend across, the mouth 304 between the internal surface 322 of the rear casing section 314 and the external surface 324 of the front casing section 312.

The nozzle 302 further comprises a guide surface 326. The guide surface 326 extends about the axis X, and is centered on the axis X. The guide surface 326 is angled relative to the diffuser portion 310 of the Coanda surface 308. In this fan assembly 300, the guide surface 326 converges inwardly towards the axis X, and is inclined to the axis X by an angle of around 15°. The depth of the guide surface 326, as measured along the axis X, is preferably in the range from 20 to 80% of the depth of the diffuser portion 310, and in this example is around 30%.

The nozzle 302 further comprises an annular outer casing section 328 which extends about the front portion of the external surface 324 of the front casing section 312. An annular housing 330 is defined between the front casing section 312 and the outer casing section 328. The housing 330 has an opening in the form of an annular slot 332 which is located at the front of the nozzle 302.

Figure 14:
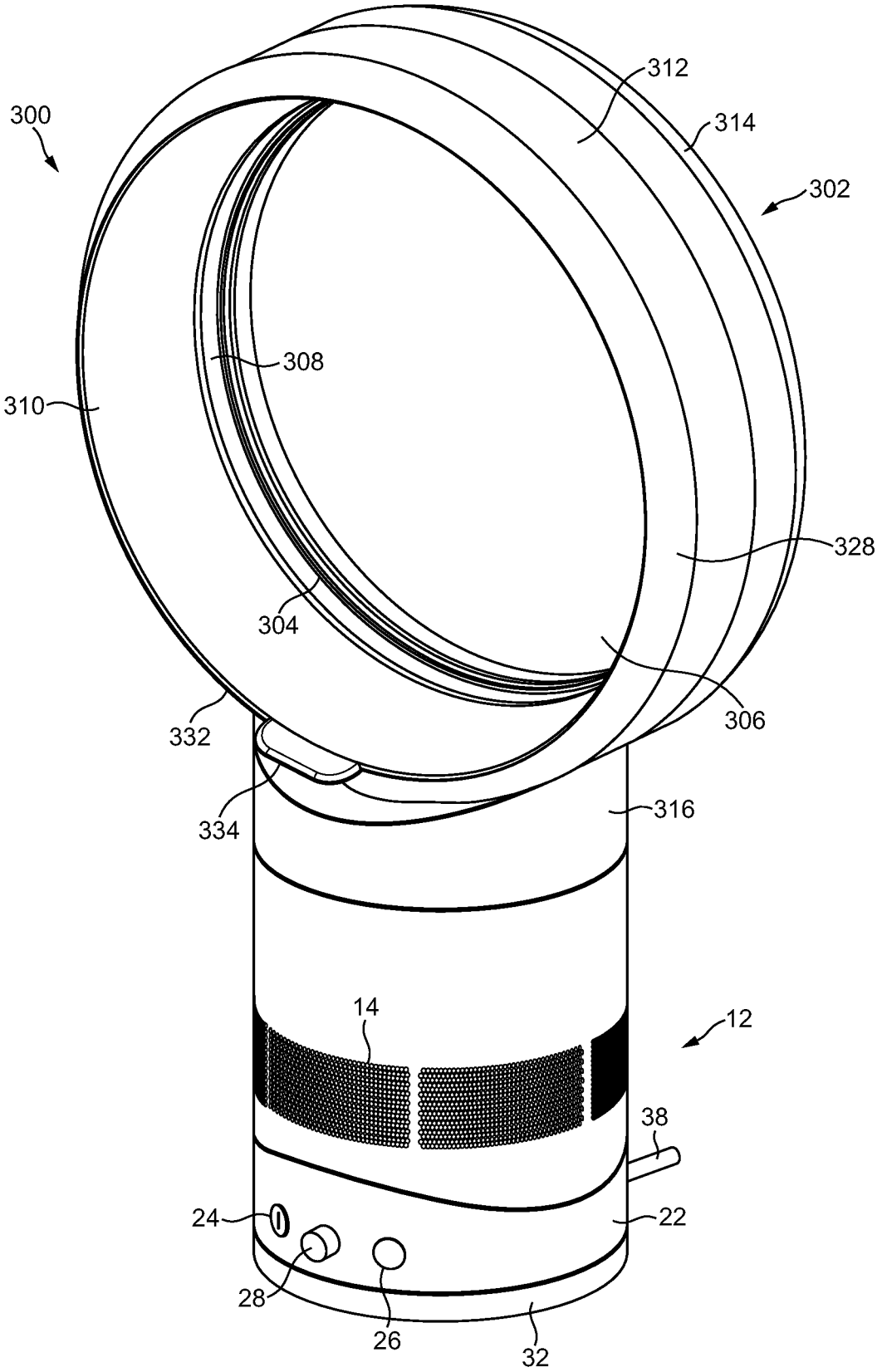
FIG. 14 is a front perspective view, from above, of a fourth fan assembly, with a nozzle of the fan assembly in a first configuration.
Figure 15:
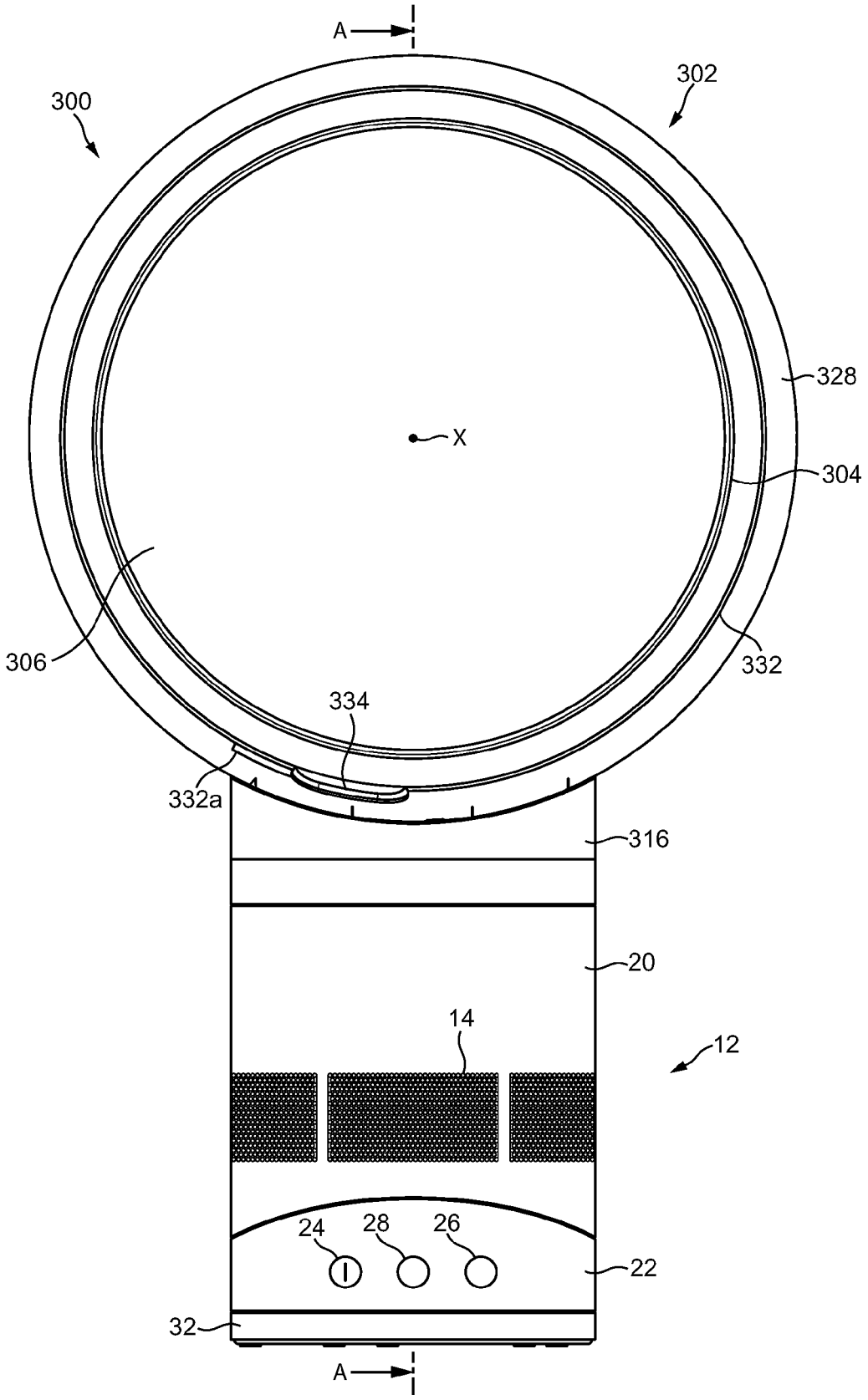
FIG. 15 is a front view of the fourth fan assembly.
Figure 16:
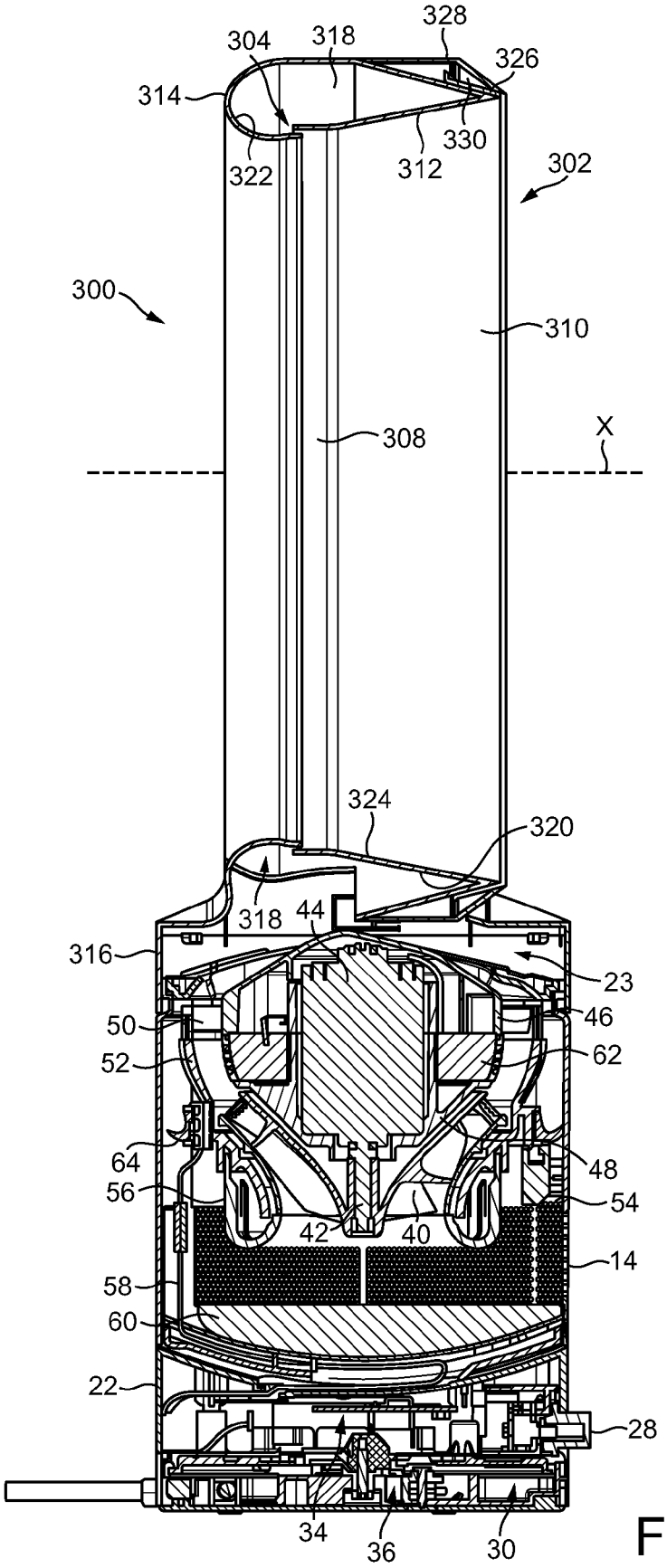
FIG. 16 is a side sectional view of the fourth fan assembly, taken along line A-A in FIG. 15.

The guide surface 326 is moveable relative to the diffuser portion 310 between a stowed position and a deployed position to adjust the configuration of the nozzle 302. FIGS. 14 to 16 illustrate the fan assembly 300 in a first configuration, in which the guide surface 326 is in its stowed position. In this position, the guide surface 326 is located substantially fully within the housing 330 so that it is shielded from the primary air flow emitted from the air outlet of the nozzle 302 during use of the fan assembly 300. In this configuration of the nozzle 302, the portion of the combined air flow which passes through the opening 306 of the nozzle 302 is not channelled or focussed towards the axis X by the guide surface 326 of the nozzle 16, and so the air combined flow has a relatively wide profile. In this configuration, the fan assembly 300 is particularly suitable for use as a desk fan in a room, office or other environment to deliver a cooling air current simultaneously to a number of users in proximity to the fan assembly 300.

When the guide surface 326 is in the stowed position, the combined air flow generated by the fan assembly 300 has a relatively high flow rate but a relatively low velocity.

The guide surface 326 comprises a tab 334 which extends forwardly from the front of the guide surface 326 so as to protrude from the housing 330 when the guide surface 326 is in its stowed position. To move the guide surface 326 from its stowed position, the user grips the tab 334 and rotates the guide surface 326 relative to the diffuser portion 310 in a clockwise direction as viewed in FIG. 15. The slot 332 has a locally enlarged region 332*a* for receiving the tab 334 as the guide surface 326 is rotated. The guide surface 326 and the external surface 324 of the front section 312 of the nozzle 302 are preferably configured so that as the guide surface 326 slides relative to the external surface 324 of the front section 314 with rotation relative to the nozzle 302, the guide surface 326 moves forwardly along the axis X. As with the nozzle 202, co-operating grooves and ridges may be formed on the guide surface 326 and the external surface 324 of the front section 312 of the nozzle 302 to guide the movement of the guide surface 326 as it is rotated relative to the nozzle 302.

Alternatively, the guide surface 326 may be pulled over the external surface of the nozzle 302 to move the guide surface 326 from its stowed position.

Figure 17:
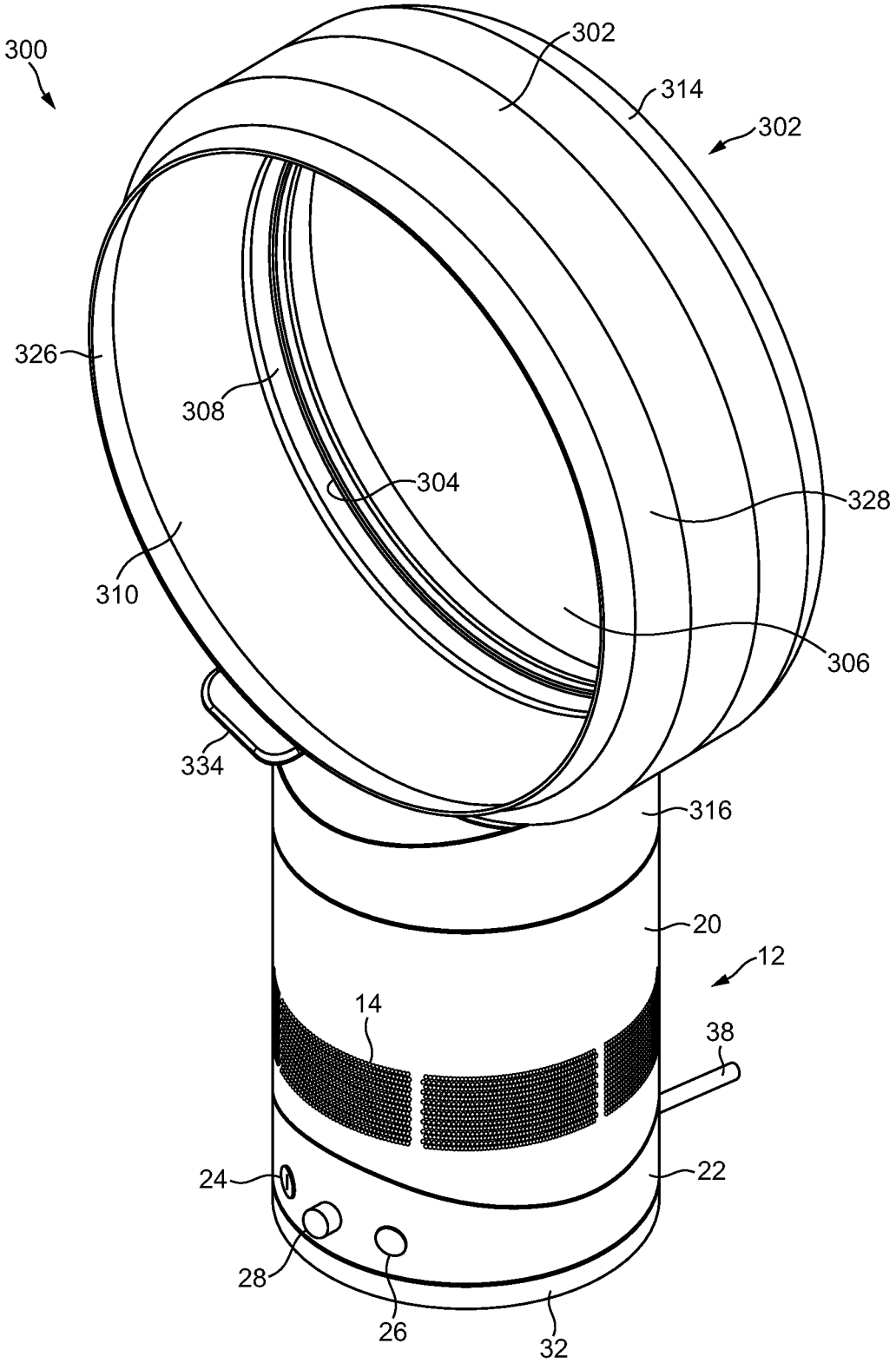
FIG. 17 is a front perspective view, from above, of the fourth fan assembly, with the nozzle in a second configuration.

By moving the guide surface 326 along the axis X, the user changes the configuration of the nozzle 302. FIG. 17 illustrates the fan assembly 300 in a second configuration, in which the guide surface 326 is in a deployed position. In this deployed position, the guide surface 326 is located downstream from the diffuser portion 310 of the Coanda surface 308, the guide surface 326 converging inwardly towards the axis X from the diffuser portion 310 of the Coanda surface 308. During use of the fan assembly 300, the portion of the combined air flow which passes through the opening 306 of the nozzle 302 is now channelled or focussed towards the axis X by the guide surface 326 of the nozzle 302, and so the combined air flow now has a relatively narrow profile. This focussing of the profile of the air flow can make the fan assembly 300 particularly suitable for use as a desk fan in a room, office or other environment to deliver a cooling air current to a single user in proximity to the fan assembly 300. When the guide surface 326 is in the fully deployed position, the combined air flow has a relatively low flow rate but a relatively high velocity.

The invention claimed is:

1. A fan assembly comprising a nozzle and a system for creating a primary air flow through the nozzle, the nozzle comprising at least one outlet for emitting the primary air flow directly into a secondary air flow from outside the fan assembly, the nozzle defining an opening through which the secondary air flow from outside the fan assembly is drawn by the primary air flow emitted from said at least one outlet, wherein the nozzle has an adjustable configuration, wherein the nozzle comprises a first part and a second part which is moveable relative to the first part, and wherein the first part and the second part of the nozzle are located downstream from the at least one outlet.

2. The fan assembly of claim 1, wherein the configuration of the nozzle is adjustable between a number of settings.

3. The fan assembly of claim 1, wherein the second part of the nozzle is moveable relative to the opening.

4. The fan assembly of claim 1, wherein the second part of the nozzle is moveable relative to the at least one outlet.

5. The fan assembly of claim 1, wherein the second part of the nozzle is located downstream of the at least one outlet.

6. The fan assembly of claim 1, wherein the second part of the nozzle is rotatable relative to the first part of the nozzle.

7. The fan assembly of claim 1, wherein the second part of the nozzle is slidably moveable relative to the first part of the nozzle.

8. The fan assembly of claim 1, wherein the second part of the nozzle is mounted on an external surface of the nozzle.

9. The fan assembly of claim 1, wherein the second part of the nozzle is moveable relative to the first part of the nozzle between a stowed position and a deployed position.

10. The fan assembly of claim 9, wherein, in the stowed position, the second part of the nozzle is shielded from the primary air flow.

11. The fan assembly of claim 9, wherein the first part of the nozzle is maintained in a fixed position relative to the at least one outlet as the second part of the nozzle is moved between the stowed position and the deployed position.

12. The fan assembly of claim 9, wherein, in the deployed position, the second part of the nozzle is located downstream from the first part of the nozzle.

13. The fan assembly of claim 1, wherein the second part of the nozzle comprises a flow guiding member.

14. The fan assembly of claim 13, wherein at least one of the position and the orientation of the flow guiding member relative to the at least one air outlet is adjustable.

15. The fan assembly of claim 1, wherein the first part of the nozzle comprises a surface over which the at least one outlet is arranged to direct the primary air flow.

16. The fan assembly of claim 15, wherein said surface comprises a cutaway portion, and wherein the second part of the nozzle is moveable relative to said surface to at least partially cover said cutaway portion.

17. The fan assembly of claim 16, wherein said surface comprises a plurality of cutaway portions, and wherein the second part of the nozzle is moveable relative to said surface to at least partially cover at least one of the cutaway portions.

18. The fan assembly of claim 17, wherein the second part of the nozzle is moveable relative to said surface to at least partially cover simultaneously each of the cutaway portions.

19. The fan assembly of claim 17, wherein the cutaway portions are regularly spaced about the nozzle.

20. The fan assembly of claim 16, wherein the, or each, cutaway portion is located at or towards a front edge of the nozzle.

21. The fan assembly of claim 15, wherein the second part of the nozzle is moveable between a stowed position and a deployed position in which the second part of the nozzle is located downstream from said surface.

22. The fan assembly of claim 21, wherein, in the stowed position, the second part of the nozzle extends about said surface.

23. The fan assembly of claim 21, wherein, in the stowed position, at least part of the second part of the nozzle is located within the nozzle.

24. The fan assembly of claim 21, wherein the second part of the nozzle tapers inwardly relative to the surface over which the at least one outlet is arranged to direct the air flow.

25. The fan assembly of claim 1, wherein the second part of the nozzle is generally annular in shape.

26. The fan assembly of claim 1, wherein at least one of the size and the shape of the opening is fixed.

27. The fan assembly of claim 1, wherein at least one of the size, the shape and the position of the at least one outlet is fixed.

28. The fan assembly of claim 1, wherein the nozzle is in the form of a loop extending about the opening.

29. The fan assembly of claim 1, wherein said at least one outlet extends about the opening.

30. The fan assembly of claim 1, wherein said at least one outlet is substantially annular in shape.

31. The fan assembly of claim 1, wherein the nozzle is mounted on a base housing said system for creating a primary air flow.

* * * * *